United States Patent [19]

Bronson et al.

[11] Patent Number: 4,797,926

[45] Date of Patent: Jan. 10, 1989

[54] DIGITAL SPEECH VOCODER

[75] Inventors: Edward C. Bronson, Lafayette, Ind.; Walter T. Hartwell, St. Charles, Ill.; Willem B. Kleijn, Batavia, Ill.; Dimitrios P. Prezas, Park Ridge, Ill.

[73] Assignee: American Telephone and Telegraph Company, AT&T Bell Laboratories, Murray Hill, N.J.

[21] Appl. No.: 906,523

[22] Filed: Sep. 11, 1986

[51] Int. Cl.[4] ..... G10L 5/00

[52] U.S. Cl. ..... 381/36; 381/37; 381/38; 381/41; 381/51

[58] Field of Search ..... 381/68.2, 30–35, 381/36–41, 53, 68; 364/513.5

[56] References Cited

U.S. PATENT DOCUMENTS

| | | | |
|---|---|---|---|
| 4,045,616 | 8/1977 | Sloane | 381/37 |
| 4,419,544 | 12/1983 | Adelman | 381/68.2 |
| 4,425,481 | 1/1984 | Mansgold et al. | 381/68.2 |
| 4,631,746 | 12/1986 | Bergeron et al. | 381/35 |
| 4,667,340 | 5/1987 | Arjmand et al. | 381/31 |

OTHER PUBLICATIONS

"A Study on the Relationships Between Stochastic and Harmonic Coding", Isabel M. Trancoso, Luis B. Almeida and Jose M. Tribolet, ICASSP 1986, pp. 1709–1712.

"A Background for Sinusoid Based Representation of Voice Speech", Jorge S. Marques and Luis B. Almeida, ICASSP 1986, pp. 1233–1236.

"Mid-Rate Coding Based on a Sinusoidal Representation of Speech", Robert J. McAulay and Thomas F. Quartieri, ICASSP 85, vol. 3 of 4, pp. 944–948.

"Variable-Frequency Synthesis: An Improved Harmonic Coding Scheme", Luis B. Almeida and Fernando M. Silva, ICASSP 84, vol. 2 of 3, pp. 27.5.1–27.5.4.

"Magnitude-Only Reconstruction Using a Sinusoidal Speech Model", R. J. McAulay and T. F. Quatieri, IEEE 1984, pp. 27.6.1–27.6.4.

*Primary Examiner*—William M. Shoop, Jr.
*Assistant Examiner*—Brian Young
*Attorney, Agent, or Firm*—John C. Moran

[57] ABSTRACT

A speech analyzer and synthesizer system using sinusoidal encoding and decoding techniques for voiced frames and noise excitation or multiple pulse excitation for unvoiced frames. For voiced frames, the analyzer transmits the pitch, values for each harmonic frequency by defining the offset from integer multiples of the fundamental frequency, total frame energy, and linear predictive coding, LPC, coefficients. The synthesizer is responsive to that information to determine the phase of the fundamental frequency and each harmonic based on the transmitted pitch and harmonic offset information and to determine the amplitudes of the harmonics utilizing the total frame energy and LPC coefficients. Once the phase and amplitudes have been determined for the fundamental and harmonic frequencies, the sinusoidal analysis is performed for voiced frames. For each frame, the determined frequencies and amplitudes are defined at the center of the frame, and a linear interpolation is used both to determine continuous frequency and amplitude signals of the fundamental and the harmonics throughout the entire frame by the synthesizer. In addition, the analyzer initially adjusts the pitch so that the harmonics are evenly distributed around integer multiples of this pitch.

30 Claims, 16 Drawing Sheets

ANALYZER
100

SYNTHESIZER
200
CHANNEL DECODER
201
139
V/U
215
221
222
220
216
211
210
230
N/M
227
HARMONIC FREQUENCY CALCULATOR
212
223
HARMONIC AMPLITUDE CALCULATOR
213
224
225
SINUSOIDAL GENERATOR
214
226
WHITE NOISE GENERATOR
203
PULSE GENERATOR
204
SEL
205
SYNTHESIS FILTER
207
SEL
206
D/A
208
218

VOICED PACKET

UNVOICED WITH WHITE NOISE EXCITATION PACKET

UNVOICED WITH PULSE EXCITATION PACKET

INTERPOLATION OF FREQUENCY

INTERPOLATION OF AMPLITUDE 4
1110
us=0 AND ls=0
YES
NO
1111
us<0 AND ls>0
YES
NO
1112
pk_l = m·fr
1113
psf=m·fr
1114
us>0
YES
NO
1115
bf=th-(P_{l-1}/2)
1116
bf=th+(P_{l-1}/2)
1117
bf<mnf
YES
NO
1118
bf=mnf
1119
m=m-1
psf=psf-fr
1120
bf>mxf
YES
NO
1121
bf=mxf
1122
m=m+1
psf=psf+fr
1123
psf<bf
YES
NO
1124
psf>bf
YES
NO
1125
S_m-S_{m-1}≥0
YES
NO
1126
S_{m+1}-S_m≤0
YES
NO
1127
pk_l = psf
1128
PEAK l LOCATED
nm=0
dn=0
6 (FIG. 12)
1107
PEAK l NOT LOCATED
P_l = P_{l-1}
5 (FIG. 12)
3

8
(FIG. 12)
1204
us > 0 AND ls < 0
1205
us = 0 AND ls = 0
1206
us < 0 AND ls > 0
1207
psf = r · fr
1208
us > 0
1209
bf = th − hpf
1210
bf < mnf
1211
bf = mnf
1212
r = r − 1
psf = psf − fr
1213
bf = th + hpf
1214
bf > mnf
1215
bf = mxf
1216
r = r + 1
psf = psf + fr
1217
psf < bf
1218
psf > bf
1219
Sr − Sr−1 ≥ 0
1220
Sr+1 − Sr ≤ 0
1221
hoq = r
1222
hoq = 0
YES
NO
9
TO PARAM ENCDR 113

DIGITAL SPEECH VOCODER

CROSS-REFERENCE TO RELATED APPLICATION

Concurrently filed herewith and assigned to the same assignees as this application is E. C. Bronson, et al., "Digital Speech Sinusoidal Vocoder with Transmission of Only a Subset of Harmonics", Application Ser. No. 906,424.

TECHNICAL FIELD

Our invention relates to speech processing and more particularly to digital speech coding and decoding arrangements directed to the replication of speech by utilizing a sinusoidal model for the voiced portion of the speech and an excited predictive filter model for the unvoiced portion of the speech.

PROBLEM

It is often desirable in digital speech communication systems including voice storage and voice response facilities to utilize signal compression to reduce the bit rate needed for storage and/or transmission. One known digital speech encoding scheme for doing signal compression is disclosed in the article by R. J. McAulay, et al., "Magnitude-Only Reconstruction Using a Sinusoidal Speech Model", Proceedings of IEEE International Conference on Acoustics, Speech, and Signal Processing, 1984, Vol. 2, p. 27.6.1–27.6.4 (San Diego, U.S.A.). This article discloses the use of a sinusoidal speech model for encoding and decoding both voiced and unvoiced portions of the speech. The speech waveform is reproduced in the synthesizer portion of a vocoder by modeling the speech waveform as a sum of sine waves. This sum of sine waves comprises the fundamental and the harmonics of the speech wave and is expressed as $$s(n)=\Sigma a_i(n)\sin[\phi_i(n)]. \quad (1)$$

The terms $a_i(n)$ and $\phi_i(n)$ are the time varying amplitude and phase, respectively, of the sinusoidal components of the speech waveform at any given point in time. The voice processing function is performed by determining the amplitudes and the phases in the analyzer portion and transmitting these values to a synthesizer portion which reconstructs the speech waveform using equation 1.

The McAulay article also discloses that the amplitudes and phases are determined by performing a fast Fourier spectrum analysis for fixed time periods, normally referred to as frames. Fundamental and harmonic frequencies appear as peaks in the fast Fourier spectrum and are determined by doing peak-picking to determine the frequencies and the amplitudes of the fundamental and the harmonics.

A problem with McAulay's method is that the fundamental frequency, all harmonic frequencies, and all amplitudes are transmitted from the analyzer to the synthesizer resulting in high bit rate transmission. Another problem is that the frequencies and the amplitudes are directly determined solely from the resulting spectrum peaks. The fast Fourier transform used is very accurate in depicting these peaks resulting in a great deal of computation.

An additional problem with this method is that of attempting to model not only the voiced portions of the speech but also the unvoiced portions of the speech using the sinusoidal waveform coding technique. The variations between voiced and unvoiced regions result in the spectrum energy from the spectrum analysis being disjoined at the boundary frames between these regions making it difficult to determine relevant peaks within the spectrum.

SOLUTION

The present invention solves the above described problems and deficiencies of the prior art and a technical advance is achieved by provision of a method and structural embodiment comprising an analyzer for encoding and transmitting for each speech frame the frame energy, speech parameters defining the vocal tract, a fundamental frequency, and offsets representing the difference between individual harmonic frequencies and integer multiples of the fundamental frequency for subsequent speech synthesis. A synthesizer is provided which is responsive to the transmitted information to calculate the phases and amplitudes of the fundamental frequency and the harmonics and to use the calculated information to generate replicated speech. Advantageously, this arrangement eliminates the need to transmit amplitude information from an analyzer to a synthesizer.

In one embodiment, the analyzer adjusts the fundamental frequency or pitch determined by a pitch detector by utilizing information concerning the harmonics of the pitch that is attained by spectrum analysis. That pitch adjustment corrects the initial pitch estimate for inaccuracies due to the operation of the pitch detector and for problems associated with the fact that it is being calculated using integer multiples of the sampling period. In addition, the pitch adjustment adjusts the pitch so that its value when properly multiplied to derive the various harmonics is the mean between the actual value of the harmonics determined from the spectrum analysis. Thus, pitch adjustment reduces the number of bits required to transmit the offset information defining the harmonics from the analyzer to the synthesizer.

Once the pitch has been adjusted, the adjusted pitch value properly multiplied is used as a starting point to recalculate the location of each harmonic within the spectrum and to determine the offset of the located harmonic from the theoretical value of that harmonic as determined by multiplying the adjusted pitch value by the appropriate number of the desired harmonic.

The invention provides a further improvement in that the synthesizer reproduces speech from the transmitted information utilizing the above referenced techniques for sinusoidal modeling for the voiced portion of the speech and utilizing either multipulse or noise excitation modeling for the unvoiced portion of the speech.

In greater detail, the amplitudes of the harmonics are determined at the synthesizer by utilizing the total frame energy determined from the original sample points and the linear predictive coding, LPC, coefficients. The harmonic amplitudes are calculated by obtaining the unscaled energy contribution from each harmonic by using the LPC coefficients and then deriving the amplitude of the harmonics by using the total energy as a scaling factor in an arithmetic operation. This technique allows the analyzer to only transmit the LPC coefficients and total energy and not the amplitudes of each harmonic.

Advantageously, the synthesizer is responsive to the frequencies for the fundamental and each harmonic, which occur in the middle of the frame, to interpolate from voice frame to voice frame to produce continuous frequencies throughout each frame. Similarly, the amplitudes for the fundamental and the harmonics are produced in the same manner.

The problems associated with the transition from a voiced to an unvoiced frame and vice versa, are handled in the following manner. When going from an unvoiced frame to a voiced frame, the frequency for the fundamental and each harmonic is assumed to be constant from the start of the frame to the middle of the frame. The frequencies are similarly calculated when going from a voiced to an unvoiced frame. The normal interpolation is utilized in calculating the frequencies for the remainder of the frame. The amplitudes of the fundamental and the harmonics are assumed to start at zero at the beginning of the voiced frame and are interpolated for the first half of the frame. The amplitudes are similarly calculated when going from a voiced to an unvoiced frame.

In addition, the number of harmonics for each voiced frame can vary from frame to frame. Consequently, there can be more or less harmonics in one voiced frame than in an adjacent voiced frame. This problem is resolved by assuming that the frequencies of the harmonics which do not have a match in the adjacent frame are constant from the middle of that frame to the boundary of the adjacent frame, and that the amplitudes of the harmonics of that frame are zero at the boundary between that frame and the adjacent frame. This allows interpolation to be performed in the normal manner.

Also, when a transition from a voiced to an unvoiced frame is made, an unvoiced LPC filter is initialized with the LPC coefficients from the previous voiced frame. This allows the unvoiced filter to more accurately synthesize the speech for the unvoiced region. Since the LPC coefficients from the voiced frame accurately model the vocal tract for the preceding period of time.

DETAILED DESCRIPTION

Figure 1:
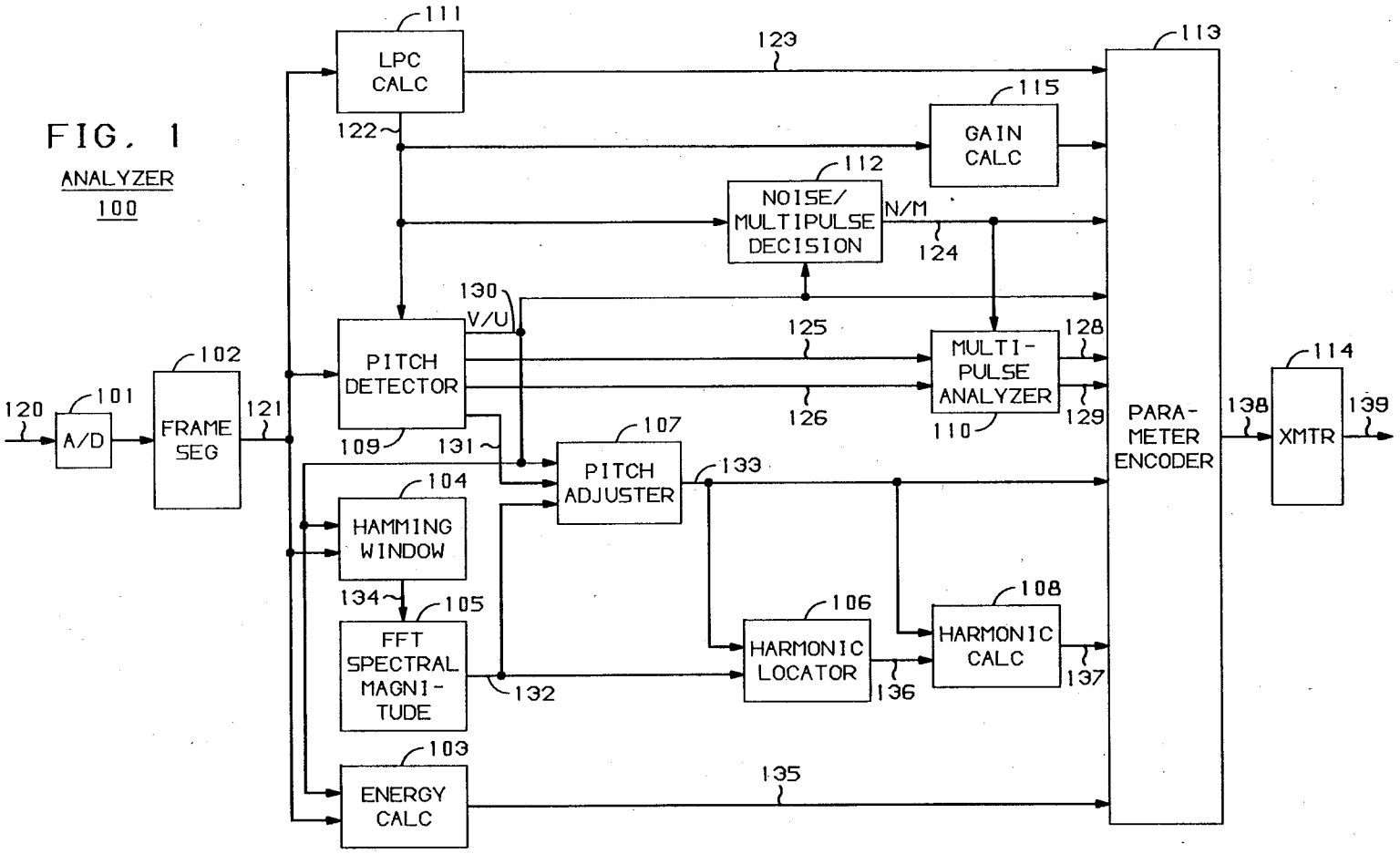
FIG. 1 illustrates, in block diagram form, a voice analyzer in accordance with this invention.
Figure 2:
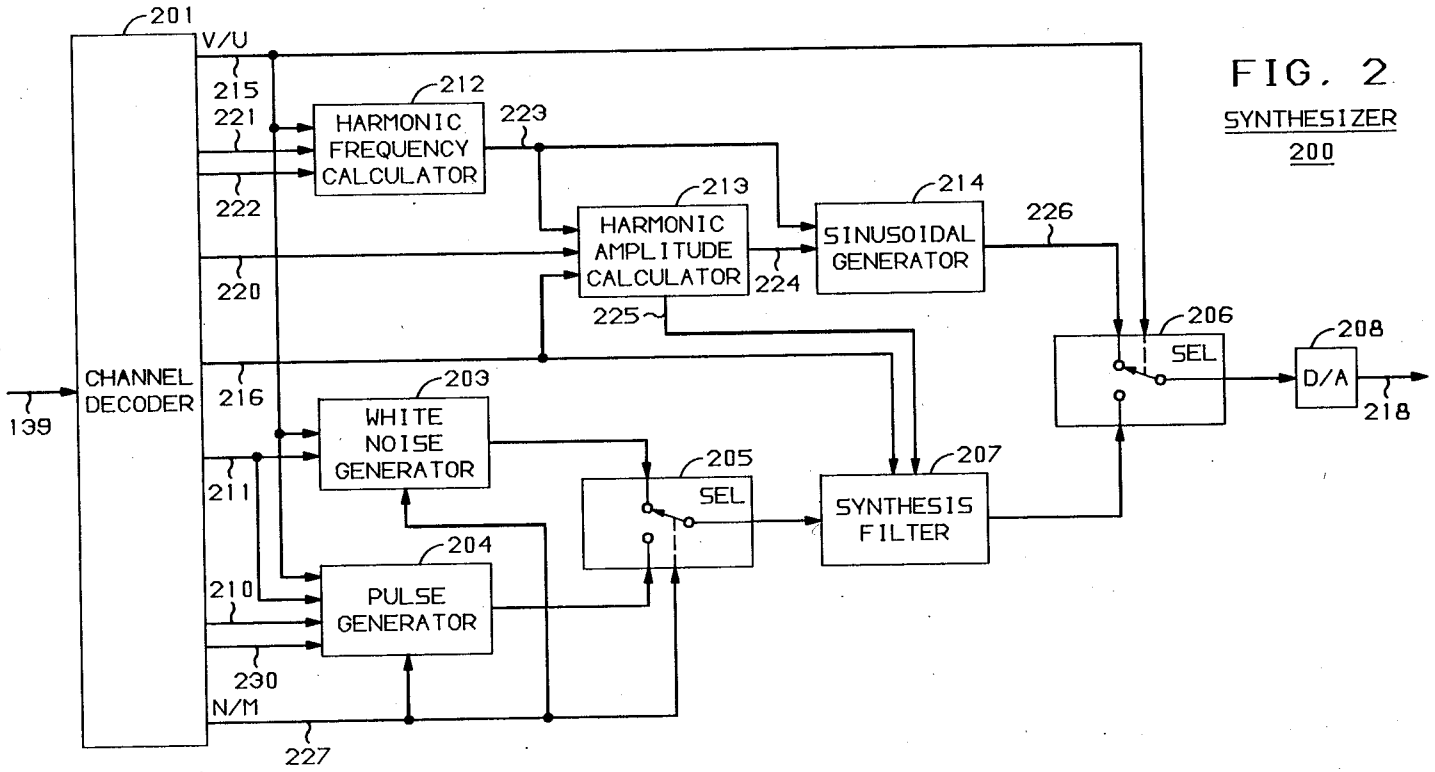
FIG. 2 illustrates, in block diagram form, a voice synthesizer in accordance with this invention.

FIGS. 1 and 2 show an illustrative speech analyzer and speech synthesizer, respectively, which are the focus of this invention. Speech analyzer 100 of FIG. 1 is responsive to analog speech signals received via path 120 to encode these signals at a low bit rate for transmission to synthesizer 200 of FIG. 2 via channel 139. Channel 139 may be advantageously a communication transmission path or may be storage so that voice synthesis may be provided for various applications requiring synthesized voice at a later point in time. One such application is speech output for a digital computer. Analyzer 100 digitizes and quantizes the analog speech information utilizing analog-to-digital converter 101 and frame segmenter 102. LPC calculator 111 is responsive to the quantized digitized samples to produce the linear predictive coding (LPC) coefficients that model the human vocal tract and to produce the residual signal. The formation of these latter coefficients and signal may be performed according to the arrangement disclosed in U. S. Pat. No. 3,740,476, issued to B. S. Atal, Jun. 19, 1973, and assigned to the same assignee as this application or in other arrangements well known in the art. Analyzer 100 encodes the speech signals received via path 120 using one of the following analysis techniques: sinusoidal analysis, multipulse analysis, or noise excitation analysis. First, frame segmentation block 102 groups the speech samples into frames which advantageously consists of 160 samples. LPC calculator 111 is responsive to each frame to calculate the residual signal and to transmit this signal via path 122 to pitch detector 109. The latter detector is responsive to the residual signal and the speech samples to determine whether the frame is voiced or unvoiced. A voiced frame is one in which a fundamental frequency normally called the pitch is detected within the frame. If pitch detector 109 determines that the frame is voiced, then blocks 103 through 108 perform a sinusoidal encoding of the frame. However, if the decision is made that the frame is unvoiced, then noise/multipulse decision block 112 determines whether noise excitation or multipulse excitation is to be utilized by synthesizer 200 to excite the filter defined by LPC coefficients which are computed by LPC calculator block 111. If noise excitation is to be used, then this fact is transmitted via parameter encoding block 113 and transmitter 114 to synthesizer 200. However, if multipulse excitation is to be used, block 110 determines locations and amplitudes of a pulse train and transmits this information via paths 128 and 129 to parameter encoding block 113 for subsequent transmission to synthesizer 200 of FIG. 2.

Figure 3:
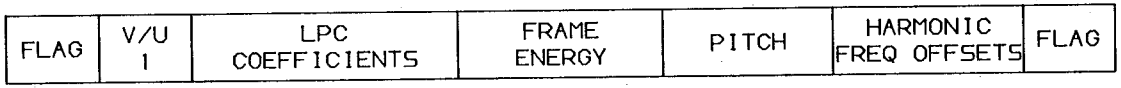
FIG. 3 illustrates a packet containing information for replicating speech during voiced regions.
Figure 4:
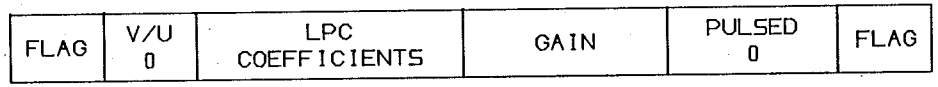
FIG. 4 illustrates a packet containing information for replicating speech during unvoiced regions utilizing noise excitation.
Figure 5:
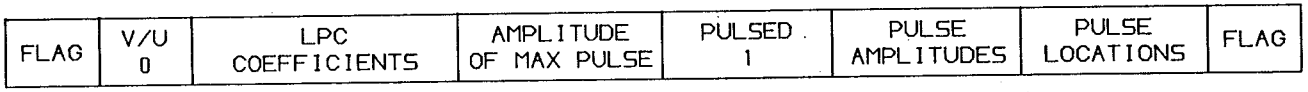
FIG. 5 illustrates a packet containing information for replicating speech during unvoiced regions utilizing pulse excitation.

If the communication channel between analyzer 100 and synthesizer 200 is implemented using packets, than a packet transmitted for a voiced frame is illustrated in FIG. 3, a packet transmitted for an unvoiced frame utilizing white noise excitation is illustrated in FIG. 4, and a packet transmitted for an unvoiced frame utilizing multipulse excitation is illustrated in FIG. 5.

Consider now the operation of analyzer 100 in greater detail. Once pitch detector 109 has signaled via path 130 that the frame is unvoiced, noise/multipulse decision block 112 is responsive to this signal to determine whether noise or multipulse excitation is utilized. If multipulse excitation is utilized, the signal indicating this fact is transmitted to multipulse analyzer block 110. Multipulse analyzer 110 is responsive to the signal on path 124 and the sets of pulses transmitted via paths 125 and 126 from pitch detector 109. Multipulse analyzer 110 transmits the locations of the selected pulses along with the amplitude of the selected pulses to parameter encoder 113. The latter encoder is also responsive to the LPC coefficients received via path 123 from LPC calculator 111 to form the packet illustrated in FIG. 5.

If noise/multipulse decision block 112 determines that noise excitation is to be utilized, it indicates this fact by transmitting a signal via path 124 to parameter encoder block 113. The latter encoder is responsive to this signal to form the packet illustrated in FIG. 4 utilizing the LPC coefficients from block 111 and the gain as calculated from the residual signal by block 115. More detail concerning the operation of analyzer 100 during unvoiced frames is described in the patent application of D. P. Prezas, et al., Case 6-1 "Voice Synthesis Utilizing Multi-Level Filter Excitation", Ser. No. 770,630, filed Aug. 28, 1985.

Consider now in greater detail the operation of analyzer 100 during a voiced frame. Energy calculator 103 is responsive to the digitized speech, $s_n$, for a frame received from frame segmenter 102 to calculate the total energy of the speech within a frame, advantageously having 160 speech samples, as given by the following equation:

$$eo = \sqrt{\sum_{n=0}^{159} s_n^2}\ . \tag{2}$$

This energy value is used by synthesizer 200 to determine the amplitudes of the fundamental and the harmonics in conjunction with the LPC coefficients.

Hamming window block 104 is responsive to the speech signal transmitted via path 121 to perform the windowing operation as given by the following equation:

$$s^h = s_n^h = s_n(0.54 - 0.46\cos((2\pi n)/159)), \quad 0 \leqq n \leqq 159. \tag{3}$$

The purpose of the windowing operation is to eliminate disjointness at the end points of a frame in preparation for calculating the fast Fourier transform, FFT. After the windowing operation has been performed, block 105 pads zero to the resulting samples from block 104 which advantageously results in a new sequence of 1024 data points as defined in the following equation:

$$s^p = \{s_0^h s_1^h \ldots s_{159}^h 0_{160} 0_{161} \ldots 0_{1023}\}. \tag{4}$$

Next, block 105 performs the fast Fourier transform which is a fast implemention of the discrete Fourier transform defined by the following equation:

$$F_k = \sum_{n=0}^{1023} s_n^h\, e^{-j(2\pi/1024)nk},\ 0 \leqq k \leqq 1023. \tag{5}$$

After performing the FFT calculations, block 105 then obtains the spectrum, S, by calculating the magnitude of each complex frequency data point resulting from the calculation performed in equation 5; and this operation is defined by the following equation:

$$S_k = \sqrt{F_k^2} = \sqrt{Re(F_k)^2 + Im(F_k)^2}\ \ 0 \leqq k \leqq 511. \tag{6}$$

Pitch adjuster 107 is responsive to the pitch calculated by pitch detector 109 and the spectrum calculated by block 105 to calculate an estimated pitch which is a more accurate refinement of the pitch than the value adjusted from pitch detector 109. In addition, integer multiples of the pitch are values about which the harmonic frequencies are relatively equally distributed. This adjustment is desirable for three reasons. The first reason is that although the first peak of the spectrum calculated by block 105 should indicate the position of the fundamental, in actuality this signal is normally shifted due to the effects of the vocal tract and the effects of a low-pass filter in analog-to-digital converter 101. The second reason is that the pitch detector's frequency resolution is limited by the sampling rate of the analog-to-digital converter; and hence, does not define the precise pitch frequency if the corresponding pitch period falls between two sample points. This effect of not having the correct pitch is adjusted for by pitch adjuster 107. The greatest impact of this is on the calculations performed by harmonic locator 106 and harmonic offsets calculator 108. Harmonic locator 106 utilizes the pitch determined by pitch adjuster 107 to create a starting point for analyzing the spectrum produced by spectrum magnitude block 105 to determine the location of the various harmonics.

The third reason is that harmonic offsets calculator 108 utilizes the theoretical harmonic frequency calculated from the pitch value and the harmonic frequency determined by locator 106 to determine offsets which are transmitted to synthesizer 200. If the pitch frequency is incorrect, then each of these offsets becomes a large number requiring too many bits to transmit to synthesizer 200. By distributing the harmonic offsets around the zero harmonic offset, the number of bits needed to communicate the harmonic offsets to synthesizer 200 is kept to a minimum number.

Pitch adjuster block 107 functions in the following manner. Since the peak within the spectrum calculated by FFT spectral magnitude block 105 corresponding to the fundamental frequency may be obscured for the previously mentioned reasons, pitch adjuster 107 first does the spectral search by setting the initial pitch estimate to be $$th_l = 2p_0 \tag{7}$$

Where $p_0$ is the fundamental frequency determined by pitch detector 109, and $th_l$ is the theoretical second harmonic. The search about this point in the spectrum determined by $th_l$ is within the region of frequencies, f, defined as $$\frac{3p_0}{2} \leqq f \leqq \frac{5p_0}{2}. \tag{8}$$

Within this region pitch adjuster 107 calculates the slopes of the spectrum on each side of the theoretical harmonic frequency and then searches this region in the direction of increasing slope until the first spectral peak is located within the search region. The frequency at which this peak occurs, $pk_l$, is then used to adjust the pitch estimate for the frame. At this point, the new pitch estimate, $p_l$, becomes $$p_1 = \frac{pk_1}{2}. \tag{9}$$

This new pitch estimate, $p_l$, is then used to calculate the theoretical frequency of the third harmonic $th_2 = 3p_l$. This search procedure is repeated for each theoretical harmonic frequency, $th_i < 3600$ hz. For frequencies above 3600 hz, low-pass filtering obscures the details of the spectrum. If the search procedure does not locate a spectral peak within the search region, no adjustment is made and the search continues for the next peak using the previous adjusted peak value. Each peak is designated as $pk_i$ where i represents the ith harmonic or harmonic number. The equation for the ith pitch estimate, $p_i$, is $$p_i = \frac{\sum_{j=1}^{i} pk_j}{\sum_{j=1}^{i} (j+1)}, \; i > 0. \tag{10}$$

The search region for the ith pitch estimate is defined by $$(i+\tfrac{1}{2})p_{i-1} \leqq f \leqq (i+3/2)p_{i-1}, \; i > 0. \tag{11}$$

After pitch adjuster 107 has determined the pitch estimate, this is transmitted to parameter encoder 113 for subsequent transmission to synthesizer 200 and to harmonic locator 106 via path 133. The latter locator is responsive to the spectrum defined by equation 6 to precisely determine the harmonic peaks within the spectrum by utilizing the final adjusted pitch value, $p_F$, as a starting point to search within the spectrum in a range defined as $$(i+\tfrac{1}{2})p_F \leqq f \leqq (i+3/2)p_F, \; 1 \leqq i \leqq h, \tag{12}$$

where h is the number of harmonic frequencies within the present frame. Each peak located in this manner is designated as $pk_i$ where i represents the ith harmonic or harmonic number. Harmonic calculator 108 is responsive to the $pk_i$ values to calculate the harmonic offset from the theoretical harmonic frequency, $ts_i$, with this offset being designated $ho_i$. The offset is defined as $$ho_i = \frac{pk_i - ts_i}{fr}, \; 1 \leqq i \leqq h, \tag{13}$$

where fr is the frequency between consecutive spectral data points which is due to the size of the calculated spectrum, S. Harmonic calculator 108 then transmits these offsets via path 137 to parameter encoder 113 for subsequent transmission to analyzer 200.

Synthesizer 200, as illustrated in FIG. 2, is responsive to the vocal tract model parameters and excitation information or sinusoidal information received via channel 139 to produce a close replica of the original analog speech that has been encoded by analyzer 100 of FIG. 1. Synthesizer 200 functions in the following manner. If the frame is voiced, blocks 212, 213, and 214 perform the sinusoidal synthesis to recreate the original speech signal in accordance with equation 1 and this reconstructed voice information is then transferred via selector 206 to digital-to-analog coverter 208 which converts the received digital information to an analog signal.

Upon receipt of a voiced information packet, as illustrated in FIG. 3, channel decoder 201 transmits the pitch and harmonic frequency offset information to harmonic frequency calculator 212 via paths 221 and 222, respectively, the speech frame energy, eo, and LPC coefficients to harmonic amplitude calculator 213 via paths 220 and 216, respectively, and the voiced/unvoiced, V/U, signal to harmonic frequency calculator 212 and selector 206. The V/U signal equaling a "1" indicates that the frame is voiced. The harmonic frequency calculator 212 is responsive to the V/U signal equaling a "1" to calculate the harmonic frequencies in response to the adjusted pitch and harmonic frequency offset information received via paths 221 and 222, respectively. The latter calculator then transfers the harmonic frequency information to blocks 213 and 214.

Harmonic amplitude calculator 213 is responsive to the harmonic frequency information from calculator 212, the frame energy information received via path 220, and the LPC coefficients received via path 216 to calculate the amplitudes of the harmonic frequencies. Sinusoidal generator 214 is responsive to the frequency information received from calculator 212 via path 223 to determine the harmonic phase information and then utilizes this phase information and the amplitude information received via path 224 from calculator 213 to perform the calculations indicated by equation 1.

If channel decoder 201 receives a noise excitation packet such as illustrated in FIG. 4, channel decoder 201 transmits a signal, via path 227, causing selector 205 to select the output of white noise generator 203 and a signal, via path 215, causing selector 206 to select the output of synthesis filter 207. In addition, channel decoder 201 transmits the gain to white noise generator 203 via path 211. Synthesis filter 207 is responsive to the LPC coefficients received from channel decoder 201 via path 216 and the output of white noise generator 203 received via selector 205 to produce digital samples of speech.

If channel decoder 201 receives from channel 139 a pulse excitation packet, as illustrated in FIG. 5, the latter decoder transmits the location and relative amplitudes of the pulses with respect to the amplitude of the largest pulse to pulse generator 204 via path 210 and the amplitudes of the pulses via path 230. In addition, channel decoder 201 conditions selector 205 via path 227, to select the output of pulse generator 204 and transfer this output to synthesis filter 207. Synthesis filter 207 and digital-to-analog coverter 208 then reproduce the speech through selector 206 conditioned by decoder 201 via path 215. Converter 208 has a self-contained low-pass filter at the output of the converter. Further information concerning the operation of blocks 203, 204, and 207 can be found in the aforementioned patent application of D. P. Prezas, et al.

Consider now in greater detail the operations of blocks 212, 213, and 214 in performing the sinusoidal synthesis of voiced frames. Harmonic frequency calculator 212 is responsive to the adjusted pitch, $p_F$, received via path 221 to determine the harmonic frequencies by utilizing the harmonic offsets received via path 222. The theoretical harmonic frequency, $ts_i$, is defined as the order of the harmonic multiplied by the adjusted pitch. Each harmonic frequency, $hf_i$, is adjusted to fall on a spectral point after being compensated by the appropriate harmonic offset. The following equation defines the ith harmonic frequency for each of the harmonics $$hf_i = ts_i + ho_i fr, \quad 1 \leqq i \leqq h, \tag{14}$$

where fr is the spectral frequency resolution.

Equation 14 produces one value for each of the harmonic frequencies. This value is assumed to correspond to the center of a speech frame that is being synthesized. The remaining per-sample frequencies for each speech sample in a frame are obtained by linearly interpolating between the frequencies of adjacent voiced frames or predetermined boundary conditions for adjacent unvoiced frames. This interpolation is performed in sinusoidal generator 214 and is described in subsequent paragraphs.

Harmonic amplitude calculator 213 is responsive to the frequencies calculated by calculator 212, the LPC coefficients received via path 216, and the frame energy received via path 220 to calculate the amplitudes of fundamental and harmonics. The LPC reflection coefficients for each voiced frame define an acoustic tube model representing the vocal tract during each frame. The relative harmonic amplitudes can be determined from this information. However, since the LPC coefficients are modeling the structure of the vocal tract, they do not contain sufficient information with respect to the amount of energy at each of these harmonic frequencies. This information is determined by using the frame energy received via path 220. For each frame, calculator 213 calculates the harmonic amplitudes which, like the harmonic frequency calculations, assumes that this amplitude is located in the center of the frame. Linear interpolation is used to determine the remaining amplitudes throughout the frame by using amplitude information from adjacent voiced frames or predetermined boundary conditions for adjacent unvoiced frames.

These amplitudes can be found by recognizing that the vocal tract can be described using an all-pole filter model, $$G(z) = \frac{1}{A(z)}, \tag{15}$$

where $$A(z) = \sum_{m=0}^{10} a_m z^{-m}, \tag{16}$$

and by definition, the coefficient $a_0 = 1$. The coefficients $a_m$, $1 \leqq m \leqq 10$, necessary to describe the all-pole filter can be obtained from the reflection coefficients received via path 216 by using the recursive step-up procedure described in Markel, J. D., and Gray, Jr., A. H., *Linear prediction of Speech,* Springer-Berlag, New York, N.Y., 1976. The filter described in equations 15 and 16 is used to compute the amplitudes of the harmonic components for each frame in the following manner. Let the harmonic amplitudes to be computed be designated $ha_i$, $0 \leqq i \leqq h$ where h is the maximum number of harmonics within the present frame. An unscaled harmonic contribution value, $he_i$, $0 \leqq i \leqq h$, can be obtained for each harmonic frequency, $hf_i$, by $$he_i = \frac{1}{\left| \sum_{m=0}^{10} a_m e^{-j(2\pi/sr)m\, hf_i} \right|^2}, \quad 0 \leqq i \leqq h, \tag{17}$$

where sr is the sampling rate. The total unscaled energy of all harmonics, E, can be obtained by $$E = \sum_{i=0}^{h} he_i. \tag{18}$$

By assuming that $$\sum_{n=0}^{159} \frac{s_n^2}{160} = \sum_{i=0}^{h} \frac{ha_i^2}{2} \tag{19}$$

for a frame size of 160 points, the ith scaled harmonic amplitude, $ha_i$, can be computed by $$ha_i = \frac{eo}{4\sqrt{5}} \left| \frac{he_i}{E} \right|^{\frac{1}{2}}, 0 \leqq i \leqq h, \quad (20)$$

where eo is the transmitted speech frame energy calculated by analyzer 100. where eo is the transmitted speech frame energy defined by equation 2 and calculated by analyzer 100.

Now consider how sinusoidal generator 214 utilizes the information received from calculators 212 and 213 to perform the calculations indicated by equation 1. For a given frame, calculators 212 and 213 provide to generator 214 a single frequency and amplitude for each harmonic in that frame. Generator 214 converts the frequency information to phase information and performs a linear interpolation for both the frequencies and amplitudes so as to have frequencies and amplitudes for each sample point throughout the frame.

Figure 6:
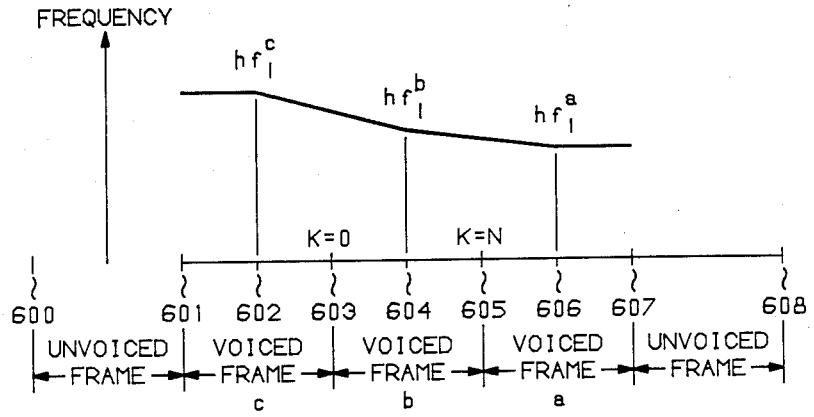
FIG. 6 illustrates, in graph form, the interpolation performed by the synthesizer of FIG. 2 for the fundamental and harmonic frequencies.

The linear interpolation is performed in the following manner. FIG. 6 illustrates 5 speech frames and the linear interpolation that is performed for the fundamental frequency which is also considered to be the 0th harmonic. For the other harmonic frequencies, there would be a similar representation. In general, there are three boundary conditions that can exist for a voice frame. First, the voice frame can have a preceding unvoiced frame and a subsequent voiced frame, second, the voice frame can be surrounded by other voiced frames, or, third, the voiced frame can have a preceding voice frame and a subsequent unvoiced frame. As illustrated in FIG. 6, frame c, points 601 through 603, represent the first condition; and the frequency $hf_i^c$ is assumed to be constant to the beginning of the frame which is defined by 601. The superscript c refers to the fact that this is the c frame. Frame b, which is after frame c and defined by points 603 through 605, represents the second case; and linear interpolation is performed between points 602 and 604 utilizing frequencies $hf_i^c$ and $hf_i^b$ which occur at point 602 and 604, respectively. The third condition is represented by frame a which extends from point 605 through 607, and the frame following frame a is an unvoiced frame defined by points 607 to 608. In this situation, the $hf_i^a$ frequency is constant to point 607.

Figure 7:
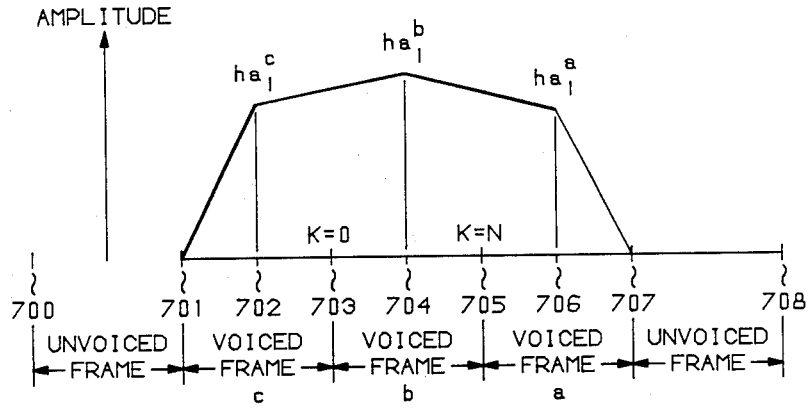
FIG. 7 illustrates, in graph form, the interpolation performed by the synthesizer of FIG. 2 for amplitudes of the fundamental and harmonic frequencies.

FIG. 7 illustrates the interpolation of amplitudes. For consecutive voiced frames such as defined by points 702 through 704, and points 704 through 706, the interpolation is identical to that performed with respect to the frequencies. However, when the previous frame is unvoiced, such as is the relationship of frame 700 through 701 to frame 701 through 703, then the harmonics at the beginning of the frame are assumed to have 0 amplitude as illustrated at the point 701. Similarly, if a voice frame is followed by an unvoiced frame, such as illustrated by frame a from 705 through 707 and frame 707 and 708, then the harmonics at the end point, such as 707 are assumed to have 0 amplitude and linear interpolation is performed.

Generator 214 performs the above described interpolation using the following equations. The persample phases of the nth sample where $O_{n,i}$, is the per-sample phase of the ith harmonic, are defined by $$O_{n,i} = O_{n-1,i} + \frac{2\pi W_{n,i}}{sr}, 0 \leqq i \leqq h,$$

where sr is the output sample rate. It is only necessary to know the per-sample frequencies, $W_{n,i}$, to solve for the phases and these per-sample-frequenc are found by doing interpolation. The linear interpolation of frequencies for a voiced frame with adjacent voiced frames such as frame b of FIG. 6 is defined by $$W_{n,i}^b = W_{n-1,i}^b + \frac{hf_i^a - hf_i^b}{160}, 80 \leqq n \leqq 159, \quad (21)$$

$$0 \leqq i \leqq h_{min},$$

and $$W_{n,i}^b = W_{n-1,i}^b + \frac{hf_i^b - hf_i^c}{160}, 0 \leqq n \leqq 79, \quad (22)$$

$$0 \leqq i \leqq h_{min},$$

where $h_{min}$ is the minimum number of harmonics in either adjacent frame. The transition from an unvoiced to a voiced frame such as frame c is handled by determining the per-sample harmonic frequency by $$W_{n,}^{i} = hf_i^c, 0 \leqq n \leqq 79. \quad (23)$$

The transition from a voiced frame to an "unvoiced frame such as frame a is handled by determining the per-sample harmonic frequencies by $$W_{n,i}^a = hf_i^a, 80 \leqq n \leqq 159. \quad (24)$$

If $h_{min}$ represents the minimum number of harmonics in either of two adjacent frames, then, for the case where frame b has more harmonics than frame c, equation 23 is used to calculate the per-sample harmonic frequencies for harmonics greater than $h_{min}$. If frame b has more harmonics than frame a, equation 24 is used to calculate the per-sample harmonic frequency for harmonics greater than $h_{min}$.

The per-sample harmonic amplitudes, $A_{n,i}$, can be determined from $ha_i$ in a similar manner and are defined for voiced frame b by $$A_{n,i}^b = A_{n-1,i}^b + \frac{ha_i^a - ha_i^b}{160}, 80 \leqq n \leqq 159, \quad (25)$$

$$0 \leqq i \leqq h_{min},$$

and $$A_{n,i}^b = A_{n-1,i}^b + \frac{ha_i^b - ha_i^c}{160}, 0 \leqq n \leqq 79, \quad (26)$$

$$0 \leqq i \leqq h_{min}.$$

When a frame is the start of a voiced region such as at the beginning of frame c, the per-sample harmonics amplitude are determined by $$A^c_{0,i} = 0,\ 0 \leqq i \leqq h, \tag{27}$$

and $$A^c_{n,i} = A^c_{n-1,i} + \frac{ha_f^c}{80},\ 1 \leqq n \leqq 79,\ 0 \leqq i \leqq h, \tag{28}$$

where H is the number of harmonics in frame c. When a frame is at the end of a voiced region such as frame a, the per-sample amplitudes are determined by $$A^a_{n,i} = A^a_{n-1,i} - \frac{ha_f^a}{80},\ 80 \leqq n \leqq 159,\ 0 \leqq i \leqq h, \tag{29}$$

where h is the number of harmonics in frame a. For the case where a frame such as frame b has more harmonics than the preceding voiced frame, such as frame c, equations 27 and 28 are used to calculate the harmonic amplitudes for the harmonics greater than $h_{min}$. If frame b has more harmonics than frame a, equation 29 is used to calculate the harmonic amplitude for the harmonics greater than $h_{min}$.

Figure 8:
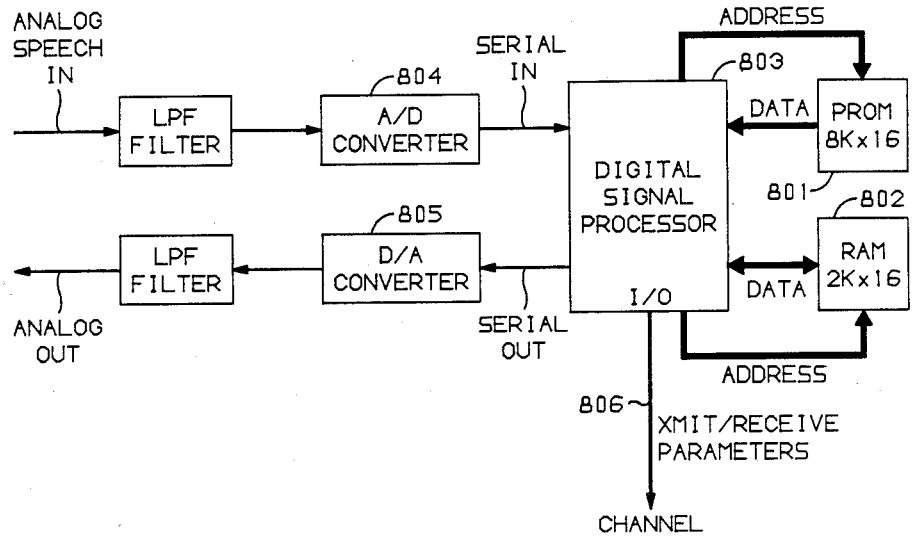
FIG. 8 illustrates a digital signal processor implementation of FIGS. 1 and 2.
Figure 9:
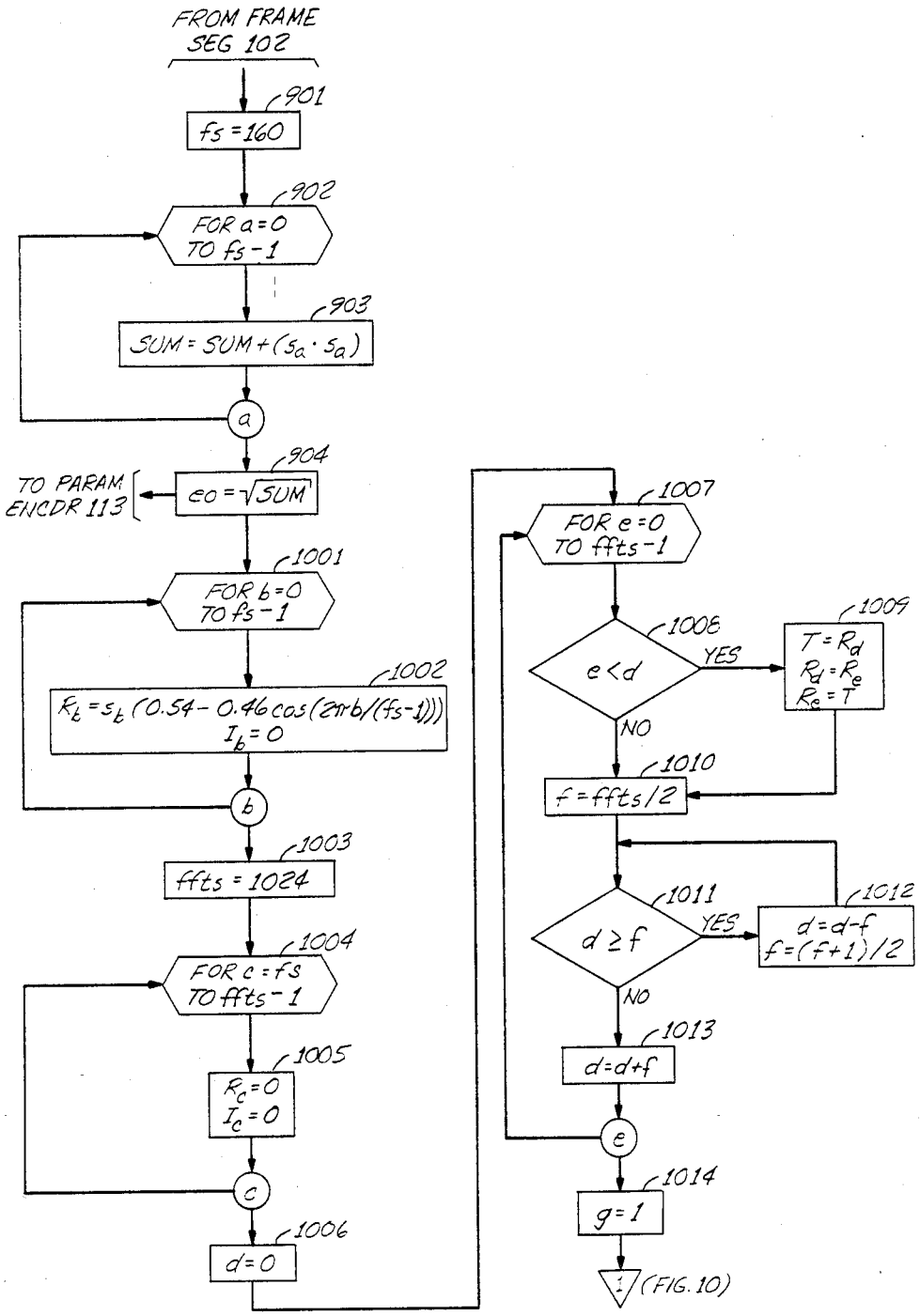
FIGS. 9 through 13 illustrate, in flowchart form, a program for controlling the digital signal processor of FIG. 8 to allow implementation of the analyzer circuit of FIG. 1.

Energy calculator 103 is implemented by processor 803 of FIG. 8 executing blocks 901 through 904 of FIG. 9. Block 901 advantageously sets the number of samples per frame to 160. Blocks 902 and 903 then proceed to form the sum of the square of each digital sample, $s_a$. After the sum has been formed, then block 904 takes the square root of this sum which yields the original speech frame energy, eo. The latter energy is then transmitted to parameter encoder 113 and to block 1001.

Hamming window block 104 of FIG. 1 is implemented by processor 803 executing blocks 1001 and 1002 of FIG. 9. These latter blocks perform the well-known Hamming windowing operation.

Figure 10:
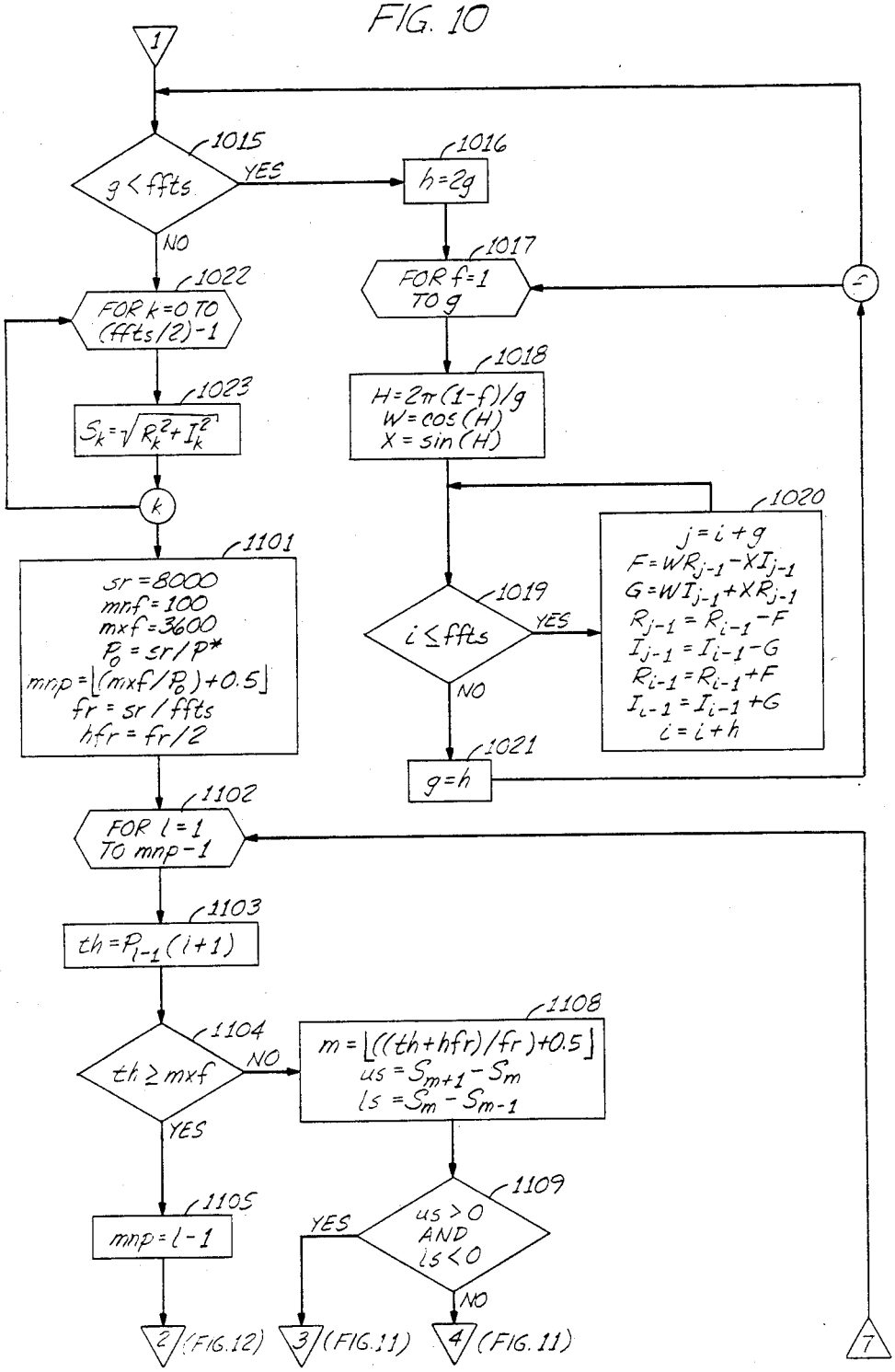

FFT spectral magnitude block 105 is implemented by the execution of blocks 1003 through 1023 of FIGS. 9 and 10. Blocks 1003 through 1005 perform the padding operation as defined in equation 4. This padding operation pads the real portion, $R_c$, and the imaginary portion, $I_c$, of point c with zeros in an array containing advantageously 1024 data points for both the imaginary and real portions. Blocks 1006 through 1013 perform a data alignment operation which is well known in the art. The latter operation is commonly referred to as a bit reversal operation because it rearranges the order of the data points in a manner which assures that the results of the FFT analysis are produced in the correct frequency domain order.

Blocks 1014 through 1021 of FIGS. 9 and 10 illustrates the implementation of the fast Fourier transform to calculate the discrete Fourier transform as defined by equation 5. After the fast Fourier analysis has been performed by the latter blocks, blocks 1022 and 1023 perform the necessary squaring and square root operations to provide the resulting spectral magnitude data as defined by equation 6.

Figure 11:
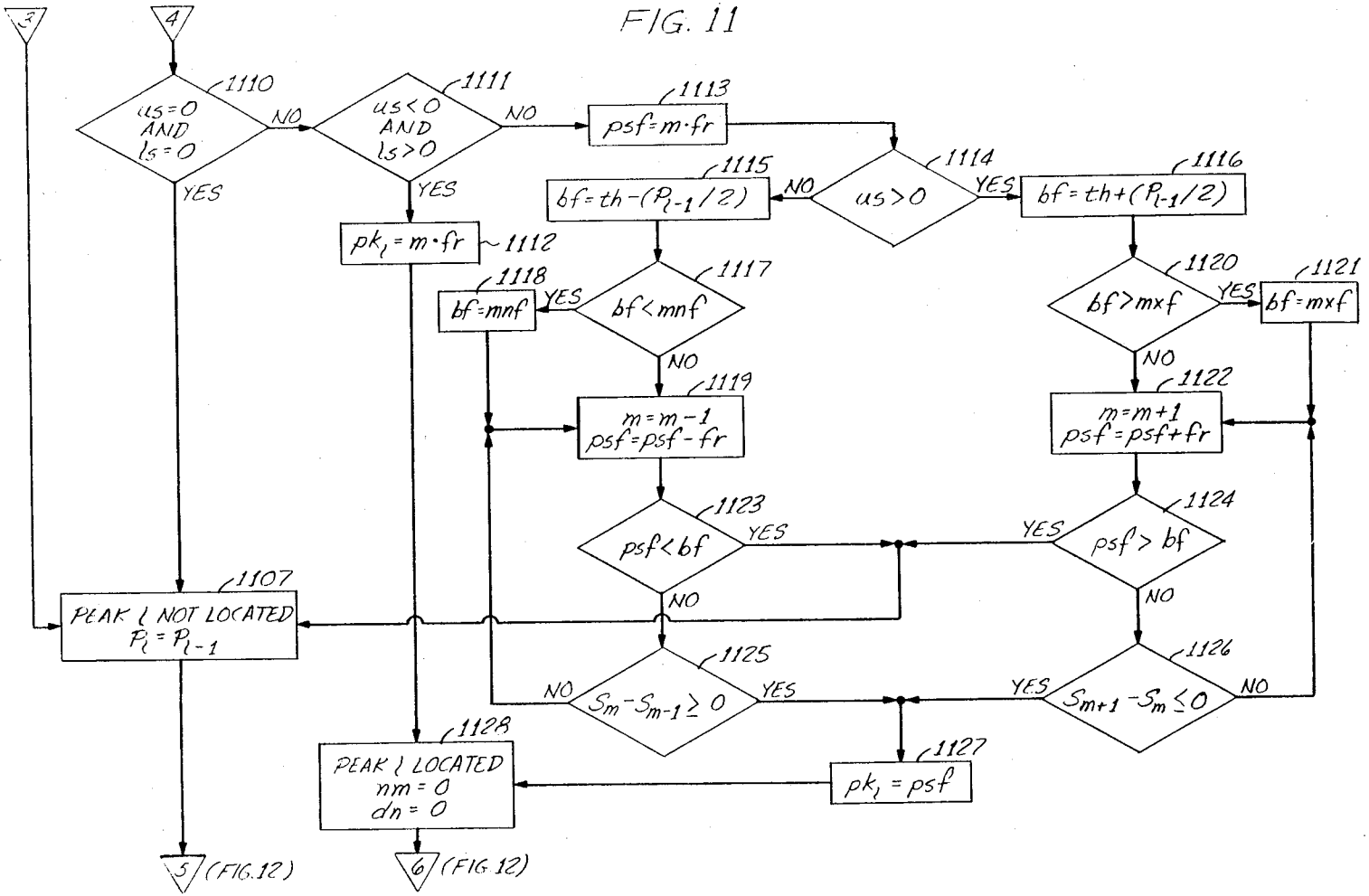
Figure 12:
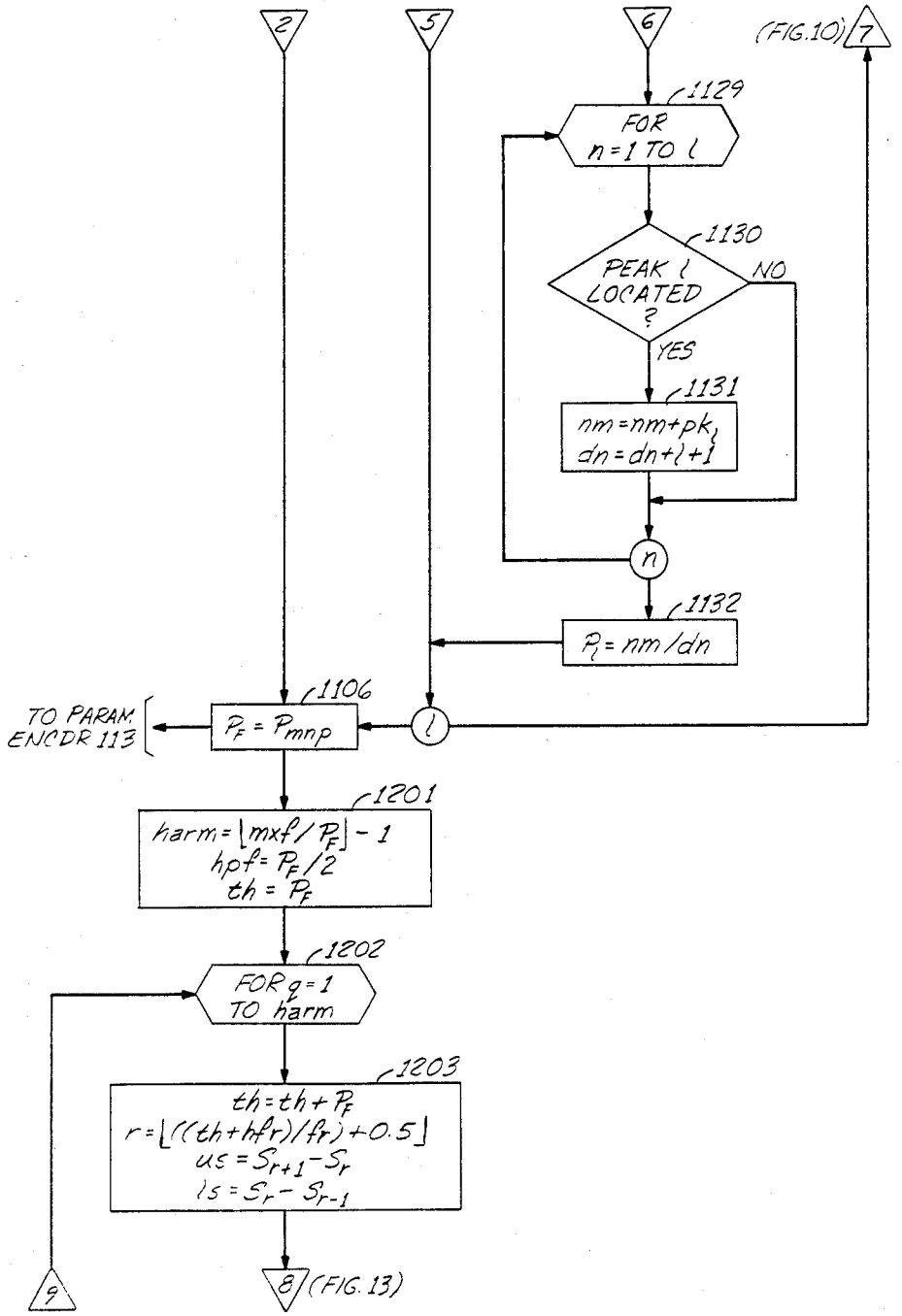

Pitch adjuster 107 is implemented by blocks 1101 through 1132 of FIGS. 10, 11, and 12. Block 1101 of FIG. 10 initializes the various variables required for performance of the pitch adjustment operation. Block 1102 determines the number of iterations which are to be performed in adjusting the pitch by searching for each of the harmonic peaks. The exception is if the theoretical frequency, th, exceeds the maximum allowable frequency, mxf, then the "for loop" controlled by block 1102 is terminated by decision block 1104. The theoretical frequency is set for each iteration by block 1103. Equation 10 determines the procedure used in adjusting the pitch, and equation 11 determines the search region for each peak. Block 1108 is used to determine the index, m, into the spectral magnitude data, $S_m$, which determines the initial data point at which the search begins. Block 1108 also calculates the slopes around this data point that are termed upper slope, us, and lower slope, ls. The upper and lower slopes are used to determine one of five different conditions with respect to the slopes of the spectrum magnitude data around the designated data point. Conditions are a local peak, a positive slope, a negative slope, a local minimum, or a flat portion of the spectrum. These conditions are tested for in blocks 1111, 1114, 1109, and 1110 of FIGS. 10 and 11. If the slope is detected as being at a minimum or a flat portion of the curve by blocks 1110 and 1109, then block 1107 is executed which sets the adjusted pitch frequency $P_l$ equal to the last pitch value determined and block 1107 of FIG. 11 is executed. If a minimum or flat portion of curve is not found, decision block 1111 is executed. If a peak is determined by decision block 1111, then the frequency of the data sample at the peak is determined by block 1112.

If the slopes of the spectrum magnitude data around the designated point were detected as being at a peak, positive slope, or negative slope, the pitch is then adjusted by blocks 1128 through 1132. This adjustment is performed in accordance with equation 10. Block 1128 sets the peak located flag and initializes the variables nm and dn which represent the numerator and the denominator of equation 10, respectively. Blocks 1129 through 1132 then implement-the calculation of equation 10. Note that decision block 1130 determines whether there was a peak located for a particular harmonic. If no peak was located the loop is simply continued and the calculations specified by block 1131 are not performed. After all the peaks have been processed, block 1132 is executed and produces an adjusted pitch that represents the pitch adjusted for the present located peak.

If the slope of the spectrum data point is detected to be positive or negative, then blocks 1113 through 1127 of FIG. 11 are executed. Initially, block 1113 calculates the frequency value for the initial sample point, psf, which is utilized by blocks 1119 and 1123, and blocks 1122 and 1124 to make certain that the search does not go beyond the point specified by equation 11. The determination of whether the slope is positive or negative is made by decision block 1114. If the spectrum data point lies on a negative slope, then blocks 1115 through 1125 are executed. The purposes of these blocks are to search through the spectral data points until a peak is found or the end of the search region is exceeded which is specified by blocks 1119 and 1123. Decision block 1125 is utilized to determine whether or not a peak has been found within the search area. If a positive slope was determined by block 1114, then blocks 1116 through 1126 are executed and perform functions similar to those performed by blocks 1115 through 1125 for the negative slope case. After the execution of blocks 1113 through 1126, then blocks 1127 through 1132 are executed in the same manner as previously described. After all of the peaks present in the spectrum have been tested, then the final pitch value is set equal to the accumulated adjusted pitch value by block 1106 of FIG. 12 in accordance with equation 10.

Figure 13:
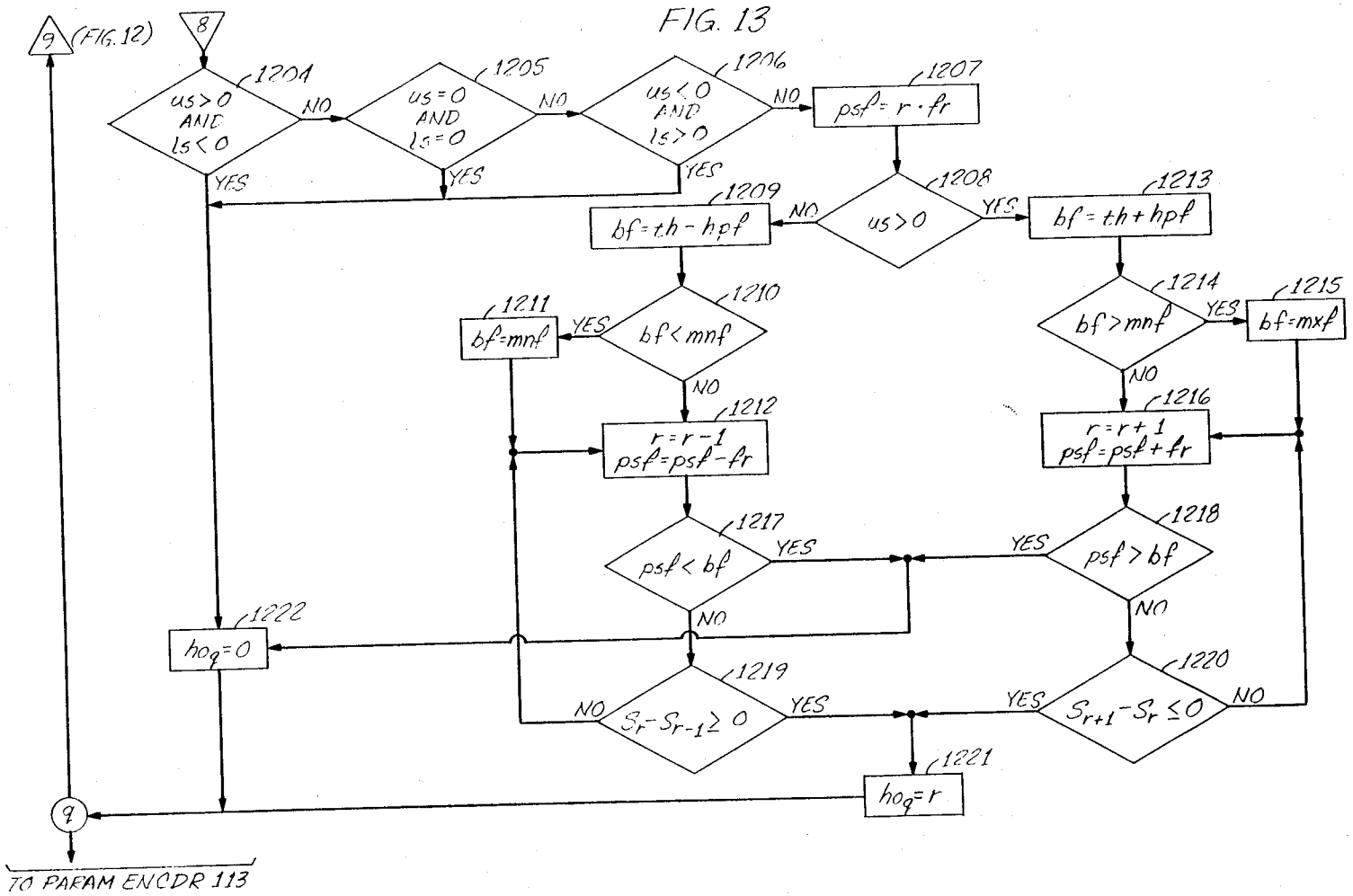

Harmonic locator 106 is implemented by blocks 1201 through 1222 of FIGS. 12 and 13. Block 1201 sets up the initial conditions necessary for locating the harmonic frequencies. Block 1202 controls the execution of blocks 1203 through 1222 so that all of the peaks, as specified by the variable, harm, are located. For each harmonic, block 1203 determines the index to be used to determine the theoretical harmonic spectral data point, the upper slope, and the lower slope. If the slope indicates a minimum, a flat region or a peak as determine by decision blocks 1204 through 1206, respectively, then block 1222 is executed which sets the harmonic offset equal to zero. If the slope is positive or negative then blocks 1207 through 1221 are executed. Blocks 1207 through 1220 perform functions similar to those performed by the previously described operations of blocks 1113 through 1126. Once blocks 1208 through 1220 have been executed, then the harmonic offset $ho_q$ is set equal to the index number, r, by block 1221.

FIGS. 14 through 19 detail the steps executed by processor 803 in implementing synthesizer 200 of FIG. 2. Harmonic frequency calculator 212 of FIG. 2 is implemented by blocks 1301, 1302, and 1303 of FIG. 14. Block 1301 initializes the parameters to be utilized in this operation. The fundamental frequency of the ith frame, $hf_0^i$ is set equal to the transmitted pitch, $P_F$. Utilizing this initial value, block 1303 calculates each of the harmonic frequencies by first calculating the theoretical frequency of the harmonic by multiplying the pitch times the harmonic number. Then, the index of the theoretical harmonic is obtained so that the frequency falls on a spectral data point and this index is added to the transmitted harmonic offset $ho_t$. Once the spectral data point index has been determined then this index is multiplied times the frequency resolution, fr, to determine the ith frame harmonic frequency, $hf_t^i$. This procedure is repeated by block 1302 until all of the harmonics have been calculated.

Figure 14:
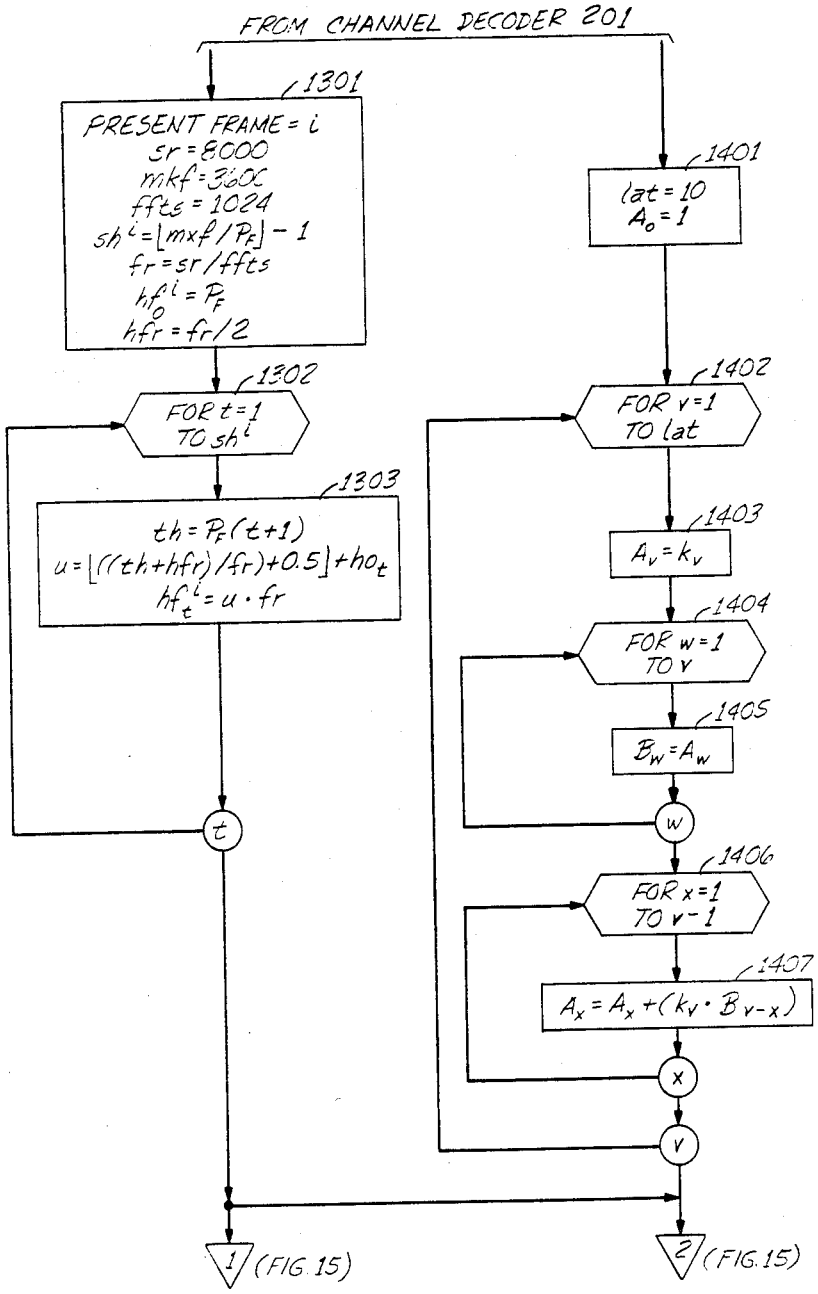
FIGS. 14 through 19 illustrate, in flowchart form, a program to control the execution of the digital signal processor of FIG. 8 to allow implementation of the synthesizer of FIG. 2.
Figure 15:
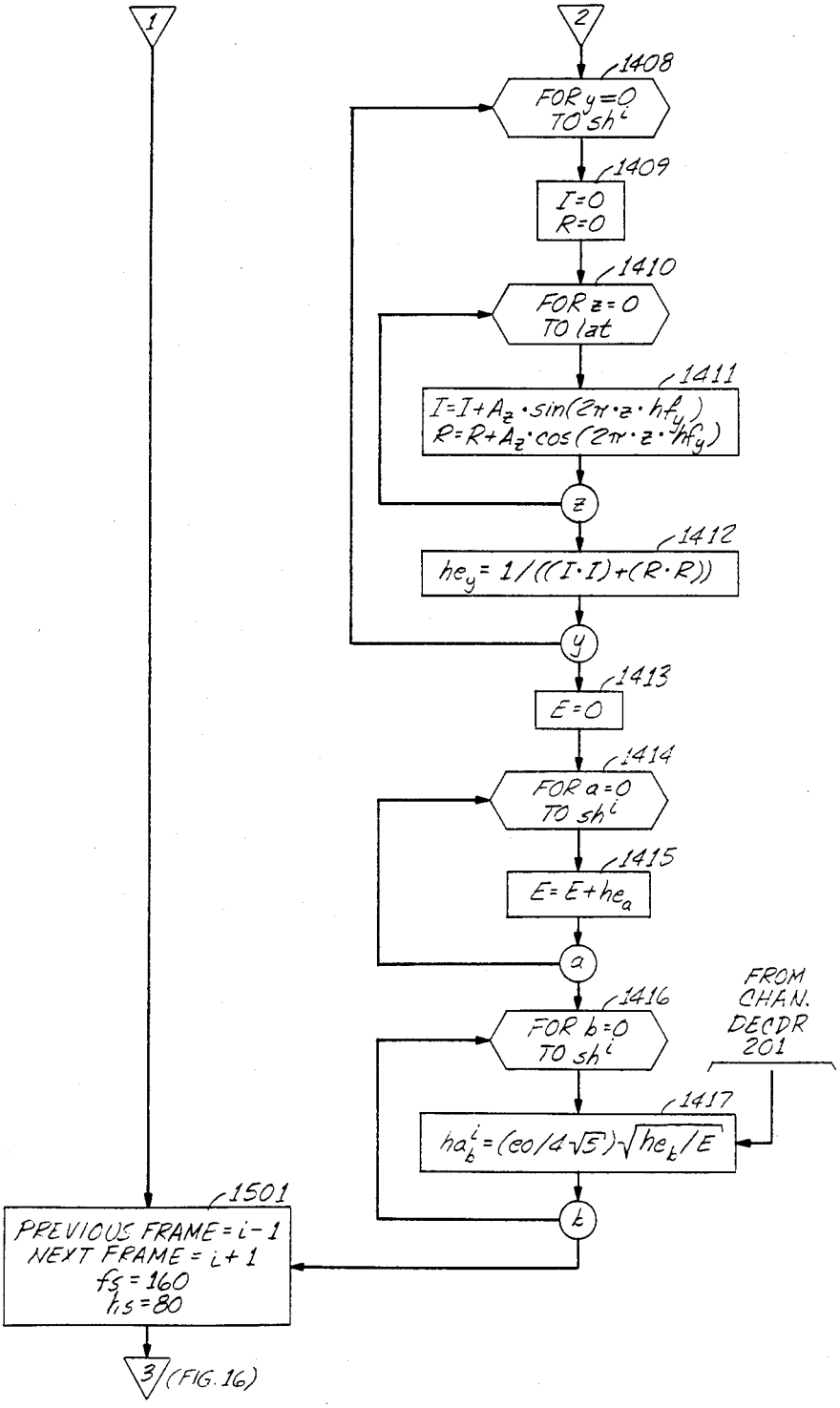

Harmonic amplitude calculator 213 is implemented by processor 803 of FIG. 8 executing blocks 1401 through 1417 of FIGS. 14 and 15. Blocks 1401 through 1407 implement the step-up procedure in order to convert the LPC reflection coefficients to the coefficients used for the all-pole filter description of the vocal tract which is given in equation 16. Blocks 1408 through 1412 calculate the unscaled harmonic energy for each harmonic as defined in equation 17. Blocks 1413 through 1415 are used to calculate the total unscaled energy, E, as defined by equation 18. Blocks 1416 and 1417 calculate the ith frame scaled harmonic amplitude, $ha_b^i$ defined by equation 20.

Blocks 1501 through 1521 and blocks 1601 through 1614 of FIGS. 15 through 18 illustrate the operations which are performed by processor 803 in doing the interpolation for the frequency and amplitudes for each of the harmonics as illustrated in FIGS. 6 and 7. These operations are performed by the first part of the frame being processed by blocks 1501 through 1521 and the second part of the frame being processed by blocks 1601 through 1614. As illustrated in FIG. 6, the first half of frame c extends from point 601 to 602, and the second half of frame c extends from point 602 to 603. The operation performed by these blocks is to first determine whether the previous frame was voiced or unvoiced.

Specifically block 1501 of FIG. 15 sets up the initial values. Decision block 1502 makes the determination of whether the previous frame had been voiced or unvoiced. If the previous frame had been unvoiced, then decision blocks 1504 through 1510 are executed. Blocks 1504 and 1507 of FIG. 17 initialize the first data point for the harmonic frequencies and amplitudes for each harmonic at the beginning of the frame to $hf_c^i$ for the phases and $a_{0,c}^i=0$ for the amplitudes. This corresponds to the illustrations in FIGS. 6 and 7. After the initial values for the first data points of the frame are set up, the remaining values for a previous unvoiced frame are set by the execution of blocks 1508 through 1510. For the case of the harmonic frequency, the frequencies are set equal to the center frequency as illustrated in FIG. 6. For the case of the harmonic amplitudes each data point is set equal to the linear approximation starting from zero at the beginning of the frame to the midpoint amplitude, as illustrated for frame c of FIG. 7.

Figure 16:
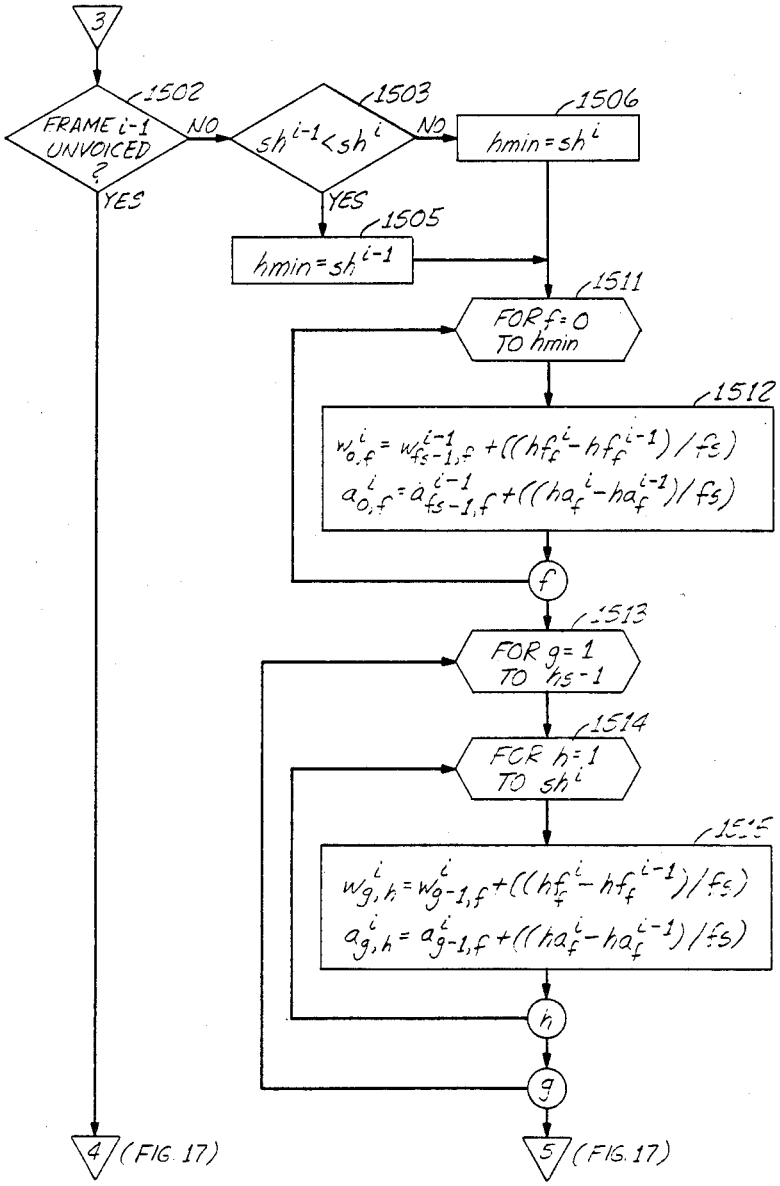
Figure 17:
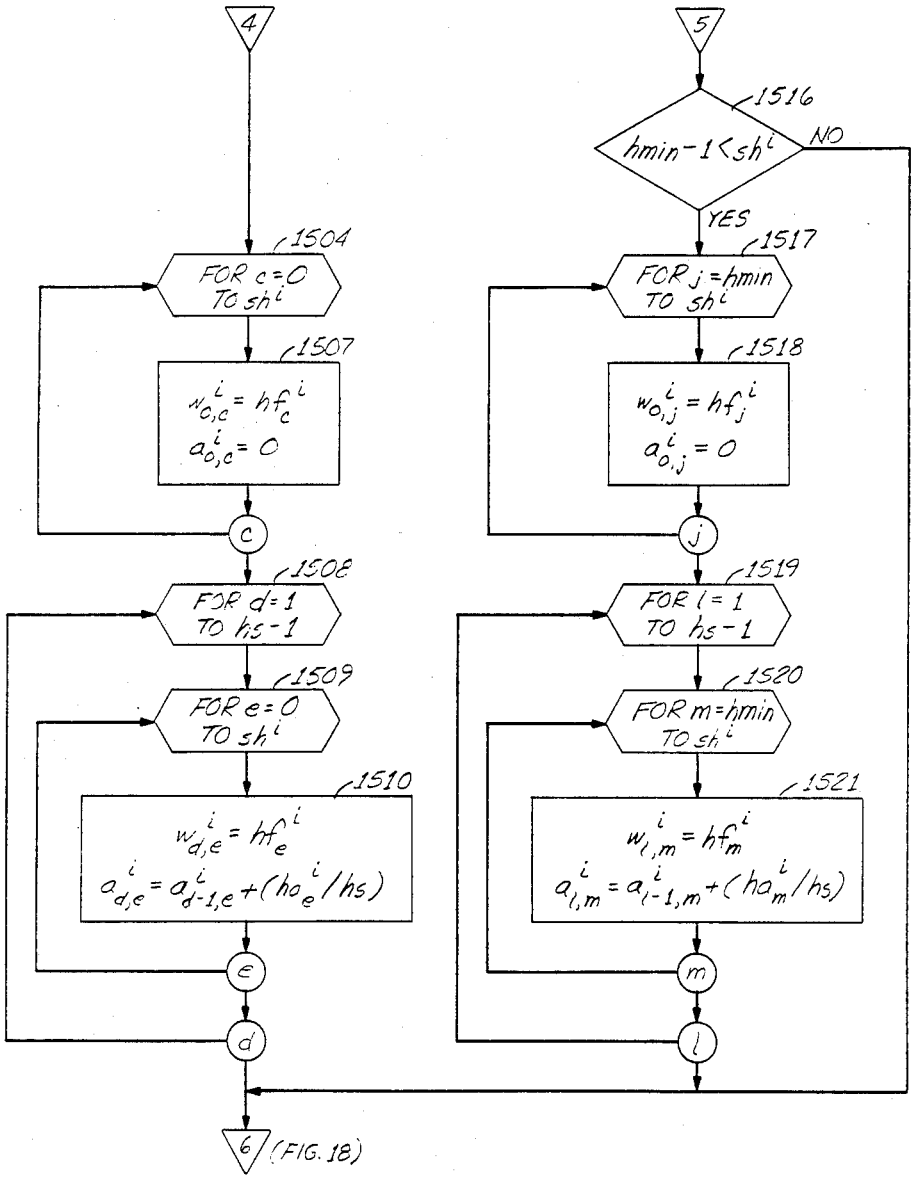
Figure 18:
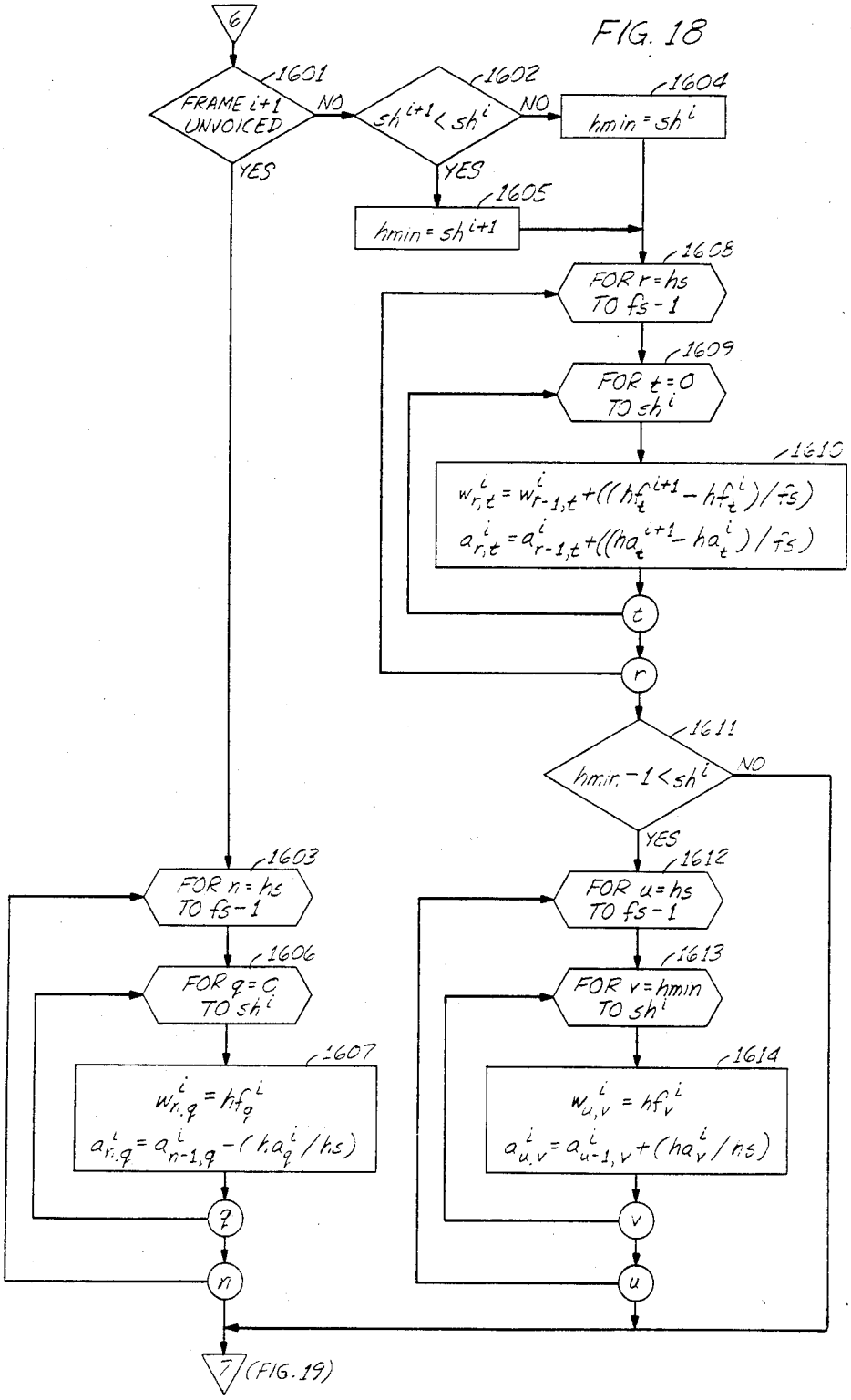
Figure 19:
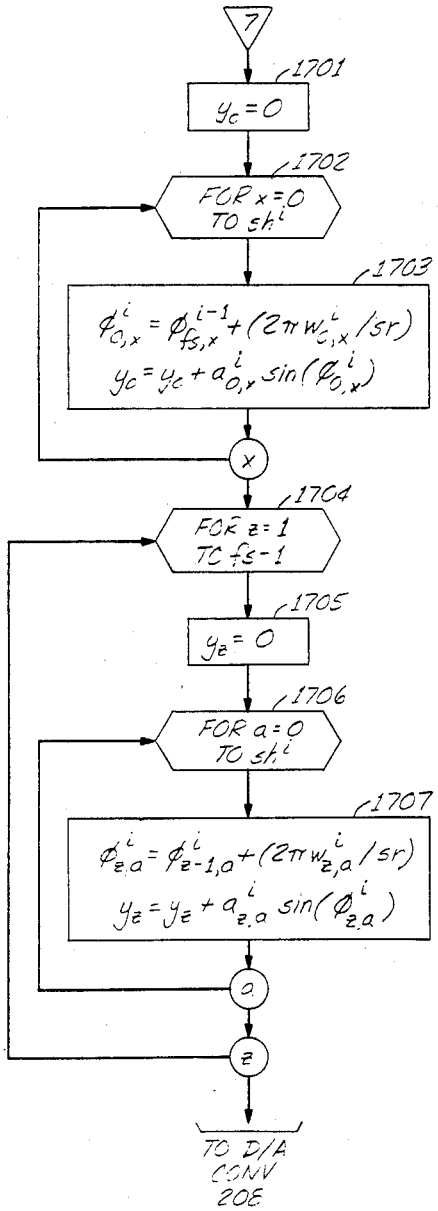

If the decision is made by block 1502 that the previous frame was voiced, then decision block 1503 of FIG. 16 is executed. Decision block 1503 determines whether the previous frame had more or less harmonics than the present frame. The number of harmonics is indicated by the variable, sh. Depending on which frame has the most harmonics determines whether blocks 1505 or 1506 is executed. The variable, hmin, is set equal to the least number of harmonic of either frame. After either block 1505 or 1506 has been executed, blocks 1511 and 1512 are executed. The latter blocks determine the initial point of the present frame by calculating the last point of the previous frame for both frequency and amplitude. After this operation has been performed for all harmonics, blocks 1513 through 1515 calculate each of the per-sample values for both the frequencies and the amplitudes for all of the harmonics as defined by equation 22 and equation 26, respectively.

After all of the harmonics, as defined by variable hmin have had their per-sample frequencies and amplitudes calculated, blocks 1516 through 1521 are calculated to account for the fact that the present frame may have more harmonics than than the previous frame. If the present frame has more harmonics than the previous frame, decision block 1516 transfers control to blocks 1517. Where there are more harmonics in the present frame than the previous frames, blocks 1517 through 1521 are executed and their operation is identical to blocks 1504 through 1510, as previously described.

The calculation of the per-sample points for each harmonic for frequency and amplitudes for the second half of the frame is illustrated by blocks 1601 through 1614. The decision is made by block 1601 whether the next frame is voiced or unvoiced. If the next frame is unvoiced, blocks 1603 through 1607 are executed. Note, that it is not necessary to determine initial values as was performed by blocks 1504 and 1507, since the first point is the midpoint of the frame for both frequency and amplitudes. Blocks 1603 through 1607 perform similar functions to those performed by blocks 1508 through 1510. If the next frame is a voiced frame, then decision block 1602 and blocks 1604 or 1605 are executed. The execution of these blocks is similar to that previously described for blocks 1503, 1505, and 1506. Blocks 1608 through 1611 are similar in operation to blocks 1513 through 1516 as previously described. Blocks 1612 through 1614 are similar in operation to blocks 1519 through 1521 as previously described.

The final operation performed by generator 214 is the actual sinusoidal construction of the speech utilizing the per-sample frequencies and amplitudes calculated for each of the harmonics as previously described. Blocks 1701 through 1707 of FIG. 19 utilize the previously calculated frequency information to calculate the phase of the harmonics from the frequencies and then to perform the calculation defined by equation 1. Blocks 1702 and 1703 determine the initial speech sample for the start of the frame. After this initial point has been determined, the remainder of speech samples for the frame are calculated by blocks 1704 through 1707. The output from these blocks is then transmitted to digital-to-analog converter 208.

It is to be understood that the above-described embodiment is merely illustrative of the principles of the invention and that other arrangements may be devised by those skilled in the art without departing from the spirit and scope of the invention.

What is claimed is:

1. A processing system for encoding human speech comprising:

means for segmenting the speech into a plurality of speech frames each having a predetermined number of evenly spaced samples of instantaneous amplitudes of speech;

means for calculating a set of speech parameter signals defining a vocal tract for each frame;

means for calculating frame energy per frame of the speech samples;

means for performing a spectral analysis of said speech samples of each frame to produce a spectrum for each frame;

means for detecting the fundamental frequency signal for each frame from the spectrum corresponding to each frame;

means for determining harmonic freequency signals for each frame from the spectrum corresponding to each frame;

means for adjusting the detected fundamental frequency signal so that the harmonic frequency signals are evenly distributed around integer multiples of the adjusted fundamental frequency signal by analysis of peaks within said spectrum representing said fundamental and harmonic frequency signals;

means for determining offset signals representing the difference between each of said harmonic frequency signals and integer multiples of said fundamental frequency signal for each frame; and means for transmitting encoded representations of said frame energy and said set of speech parameters and said fundamental frequency and said offset signals for subsequent speech synthesis.

2. The system of claim 1 wherein said means for determining said harmonic frequency signals comprises means for searching said spectrum to determine said harmonic frequency signals using multiples of said adjusted fundamental frequency signal as a starting point for each of said harmonic frequency signals.

3. The system of claim 1 further comprises means for designating frames as voiced and unvoiced;

means for forming noise-like excitation information upon the speech of one of said frames resulting from a noise-like source in the human larynx and said designating means indicating an unvoiced frame;

means for forming multipulse excitation information upon the absence of the noise-like source and said designating means indicating an unvoiced frame; and said transmitting means further responsive to said noise-like excitation information and said multipulse excitation information and said set of speech parameters for transmitting encoded representations of said noise-like and multipulse excitation information and said set of speech parameters for subsequent speech synthesis.

4. A processing system for synthesizing voice that has been segmented into a plurality of frames each having a predetermined number of evenly spaced samples of instantaneous amplitude of speech with each frame encoded by frame energy and a set of speech parameters and a fundamental frequency signal of the speech and offset signals representing the difference between the theoretical harmonic frequencies as derived from the fundamental frequency signal and the actual harmonic frequencies, comprising:

means responsive to the offset signals and the fundamental frequency signal of one of said frames for calculating the harmonic phase signals for each of the harmonic frequencies for each one of said frames;

means responsive to the frame energy and the set of speech parameters of said one of said frames for determining the amplitudes of said harmonic phase signals; and means for generating replicated speech in responsive to said harmonic phase signals and said determined amplitudes for said one of said frames.

5. The system of claim 4 wherein said determining means comprises means for calculating the unscaled energy of each of said harmonic phase signals using said set of speech parameters for said one of said frames;

means for summing said unscaled energy for all of said harmonic phase signals for said one of said frames; and means responsive to said harmonic energy of each of said harmonic phase signals and the summed unscaled energy and said frame energy for said one of said frames for computing the harmonic amplitudes of said harmonic phase signals.

6. The system of claim 4 wherein each of said harmonic phase signals comprises a plurality of samples and said calculating means comprises:

means for adding each of said offset signals to said fundamental frequency signal to obtain a harmonic frequency signal for each of said harmonic phase signals; and means responsive to the harmonic frequency signal for said one of said frames and the corresponding harmonic frequency signal for the previous and subsequent ones of said frames for each of said harmonic phase signals for interpolating to obtain said plurality of harmonic samples for each of said harmonic phase signals for said one of said frames upon said previous and subsequent ones of said frames being voiced frames.

7. The system of claim 6 wherein said interpolating means performs a linear interpolation.

8. The system of claim 7 wherein said harmonic frequency signal for said one of said frames for each of said harmonic phase signals is located in the center of said one of said frames.

9. The system of claim 8 wherein said interpolating means comprises a first means for setting a subset of said plurality of harmonic samples for each of said harmonic phase signals from each of said harmonic frequency signals to the beginning of said frames equal to each of said harmonic frequency signals upon said previous one of said frames being an unvoiced frame; and a second means for setting another subset of said plurality of harmonic phase samples for each of said harmonic phase signals from each of said harmonic frequency signals to the end of said one of said frames equal to said harmonic frequency signal for each of said harmonic phase signals upon said sequential one of said frames being an unvoiced frame.

10. The system of claim 8 wherein said interpolating means comprises a first means for setting a subset of said plurality of harmonic samples for each of said harmonic phase signals whose harmonic number is greater than the number of harmonics in said previous one of said frames equal to the corresponding harmonic frequency signal from the beginning of said one of said frames to said corresponding sample; and a second means for setting another subset of said plurality of said harmonic samples for each of said harmonic phase signals whose harmonic number is greater than the number of harmonics in said subsequent one of said frames equal to the corresponding harmonic frequency signal from said corresponding harmonic frequency signal to the end of said one of said frames.

11. The system of claim 5 wherein each of said amplitudes of said harmonic phase signals comprises a plurality of amplitude samples and said computing means comprises:

means responsive to the computed harmonic amplitude for said one of said frames and the computed harmonic amplitude samples for the previous and subsequent ones of said frames for each of said harmonic phase signals for interpolating to obtain said plurality of amplitude samples for each of said harmonic phase signals for said one of said frames upon said previous and subsequent ones of said frames being voiced frames.

12. The system of claim 11 wherein said interpolating means performs a linear interpolation.

13. The system of claim 12 wherein said computed harmonic amplitude for said one of said frames for each of said harmonic phase signals is located in the center of said one of said frames.

14. The system of claim 11 wherein said interpolating means comprises first means responsive to said previous one of said frames being an unvoiced frame for calculating a subset of said plurality of amplitude samples for each of said harmonic phase signals from each of said computed harmonic amplitudes to the beginning of said frames by setting the beginning amplitude sample equal to a predetermined value; and a second means responsive to said sequential one of said frames being an unvoiced frame for calculating another subset of said plurality of amplitude samples for each of harmonic phase signals from each of said computed amplitudes to the end of said one of said frames by setting the end amplitude sample equal to said predefined value.

15. The system of claim 13 wherein said interpolating means comprises a first means of setting a subset of said plurality of amplitude samples for each of said harmonic phase signals whose harmonic number is greater than the number of harmonics in said previous one of said frames equal to the computed harmonic amplitude from the beginning of said one of said frames to said computed harmonic amplitude; and a second means for setting another subset of said plurality of said amplitude samples for each of said harmonic phase signals whose harmonic number is greater than the number of harmonics in said subsequent one of said frames equal to said computed harmonic amplitude from said computed harmonic amplitude to the end of said one of said frames.

16. The system of claim 15 each of said frames is further encoded by multipulse excitation information and an excitation type signal upon said one of said frames being unvoiced and said system further comprises means for synthesizing said one of said frames of speech utilizing said set of speech parameter signals using noise-like excitation upon said excitation type indicating noise; and said synthesizing means further responsive to said speech parameter signals and said multipulse excitation information to synthesize said one of said frames of speech utilizing said multipulse excitation information and said set of speech parameter signals upon said excitation type signal indicating multipulse excitation.

17. The system of claim 16 wherein said synthesizing means further comprises means responsive to said set of parameter signals from said previous frames to initialize said synthesizing means upon said one of said frames being the first unvoiced frame of an unvoiced region.

18. The system of claim 4 wherein said generating means performs a sinusoidal synthesis to produce the replicated speech utilizing said harmonic phase signals and said determined amplitudes for said one of said frames.

19. A method for encoding human speech comprising the steps of:

segmenting the speech into a plurality of speech frames each having a predetermined number of evenly spaced samples of instantaneous amplitudes of speech;

calculating a set of speech parameter signals defining a vocal tract for each frame;

calculating the frame energy per frame of the speech samples;

perforing a spectral analysis of said speech samples of each frame to produce a spectrum for each frame;

detecting the fundamental frequency signal for each frame from said spectrum;

determining harmonic frequency signals from said spectrum;

adjusting the detected fundamental frequency signal so that the harmonic frequency signals are evenly distributed around the adjusted fundamental frequency signal by analysis of peaks within said spectrum representing said fundamental and harmonic frequency signals;

determining offset signals representing the difference between each of said harmonic frequency signals and multiples of said fundamental frequency signal; and transmitting encoded representations of said frame energy and said set of speech parameters and said fundamental frequency and said offset signals for subsequent sinusoidal speech synthesis.

20. The method of claim 19 wherein said step of determining said harmonic frequency signals comprises the step of searching said spectrum to determine said harmonic frequency signals using multiples of said adjusted fundamental frequency signal as a starting point for each of said harmonic frequency signals.

21. The method of claim 19 further comprises the steps of designating frames as unvoiced;

forming noise-like excitation information to indicate the use of noise upon the speech of said one of said frames resulting from a noise-like source in the human larynx and said designating step indicating an unvoiced frame;

forming multipulse excitation information upon the absence of the noise-like source and said designating step indicating an unvoiced frame; and said transmitting step further responsive to said noise-like excitation information and said multipulse excitation information and said set of speech parameters for transmitting encoded representation of said noise-like and multipulse excitation information and said set of speech parameters for subsequent speech synthesis.

22. A method for synthesizing voice that has been segmented into a plurality of frames each having a predetermined number of evenly spaced samples of instantaneous amplitude of speech with each frame encoded by frame energy and a set of speech parameters and a fundamental frequency signal of the speech and offset signals representing the difference between the theoretical harmonic frequencies as derived from the fundamental frequency signal and the actual harmonic frequencies, comprising the steps of:

calculating the harmonic phase signals for each of the harmonic frequencies for each one of said frame in response to the offset signals and the fundamental frequency signal of one of said frames;

determining the amplitudes of said harmonic phase signals in response to the frame energy and the set of speech parameters of said one of said frames; and generating replicated speech in response to said harmonic phase signals and said determined amplitudes for said one of said frames.

23. The method of claim 22 wherein said determining step comprises the steps of calculating the unscaled energy of each of said harmonic phase signals using said set of speech parameters for said one of said frames;

summing said unscaled energy for all of said harmonic phase signals for said one of said frames; and computing the harmonic amplitudes of said harmonic phase signals in response to said harmonic energy of each of said harmonic phase signals and the summed unscaled energy and said frame energy for said one of said frames.

24. The method of claim 22 wherein each of said harmonic phase signals comprises a plurality of samples and said calculating step comprises the steps of:

adding each of said offset signals to integer multiples of said fundamental frequency signal to obtain a harmonic frequency signal for each of said harmonic phase signals; and interpolating, in response to the harmonic frequency signal for said one of said frames and the corresponding harmonic frequency signal for the previous and subsequent ones of said frames for each of said harmonic phase signals, to obtain said plurality of harmonic samples for each of said harmonic phase signals for said one of said frames upon said previous and subsequent ones of said frames being voiced frames.

25. The method of claim 24 wherein said interpolating step performs a linear interpolation.

26. The method of claim 25 wherein said harmonic frequency signal for said one of said frames for each of said harmonic phase signals is located in the center of said one of said frames.

27. The method of claim 23 wherein each of said amplitud of said harmonic phase signals comprises a plurality of amplitude samples and said computing step comprises the step of interpolating, in response to the computed harmonic amplitude for said one of said frames and the computed harmonic amplitude samples for the previous and subsequent ones of said frames for each of said harmonic phase signals, to obtain said plurality of amplitude samples for each of said harmonic phase signals for said one of said frames upon said previous and subsequent ones of said frames being voiced frames.

28. The method of claim 27 wherein said interpolating step performs a linear interpolation.

29. The method of claim 28 wherein said computed harmonic amplitude for said one of said frames for each of said harmonic phase signals is located in the center of said one of said frames.

30. The method of claim 29 each of said frames is furth encoded by multipulse excitation information and an excitation type signal upon said one of said frames being unvoiced and said method further comprises the steps of:

synthesizing said one of said frames of speech utilizing said set of speech parameter signals and noise-like excitation upon said excitation type indicating noise; and synthesizing, in further responsive to said of speech parameter signals and said multipulse excitation information, said one of said frames of speech utilizing said multipulse excitation information and said set of speech parameter signals upon said excitation type signal indicating multipulse excitation.

* * * * *

UNITED STATES PATENT AND TRADEMARK OFFICE

CERTIFICATE OF CORRECTION

PATENT NO. : 4,797,926

DATED : January 10, 1989

INVENTOR(S) : Edward C. Bronson, Walter T. Hartwell, Willem B. Klejn, Dimitrios P. Prezas It is certified that error appears in the above-identified patent and that said Letters Patent is hereby corrected as shown below:

Column 21, line 42, "as unvoiced;" should be --as voiced and unvoiced;--.

Column 22, line 47, "amplitud" should be --amplitudes--.

Column 22, line 67, "furth" should be --further--.

Signed and Sealed this

Fourth Day of May, 1993

*Attest:*

*Attesting Officer*

Michael K. Kirk

MICHAEL K. KIRK

*Acting Commissioner of Patents and Trademarks*